US011346311B2

(12) United States Patent
Yanoto

(10) Patent No.: US 11,346,311 B2
(45) Date of Patent: May 31, 2022

(54) FUEL INJECTION CONTROL DEVICE FOR INTERNAL COMBUSTION ENGINE

(71) Applicant: DENSO CORPORATION, Kariya (JP)

(72) Inventor: Keisuke Yanoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 437 days.

(21) Appl. No.: 15/774,401

(22) PCT Filed: Nov. 2, 2016

(86) PCT No.: PCT/JP2016/082637
§ 371 (c)(1),
(2) Date: May 8, 2018

(87) PCT Pub. No.: WO2017/094430
PCT Pub. Date: Jun. 8, 2017

(65) Prior Publication Data

US 2020/0141347 A1 May 7, 2020

(30) Foreign Application Priority Data

Nov. 30, 2015 (JP) ..... JP2015-233462
Aug. 12, 2016 (JP) ..... JP2016-158557

(51) Int. Cl.
*F02M 51/00* (2006.01)
*F02D 41/24* (2006.01)
(Continued)

(52) U.S. Cl.
CPC ..... *F02M 51/00* (2013.01); *F02D 41/2467* (2013.01); *F02D 2041/2003* (2013.01);
(Continued)

(58) Field of Classification Search
CPC ..... F02D 41/2467; F02D 2041/2058; F02D 2041/2003; F02D 2041/2055; F02D 2041/2034; F02D 2200/063; F02M 51/06
See application file for complete search history.

(56) References Cited

U.S. PATENT DOCUMENTS 4,479,161 A * 10/1984 Henrich ..... H01H 47/325 361/154
4,618,908 A * 10/1986 Anttila ..... F02D 41/20 361/187
(Continued)

FOREIGN PATENT DOCUMENTS

CN 102518523 A * 6/2012
JP 2010-043603 2/2010
(Continued)

*Primary Examiner* — Logan M Kraft
*Assistant Examiner* — Joshua Campbell
(74) *Attorney, Agent, or Firm* — Nixon & Vanderhye P.C.

(57) ABSTRACT

A fuel injection control device for an internal combustion engine which is applied to a fuel injection system of the internal combustion engine, the fuel injection system including fuel injectors, driving circuits that drive the fuel injectors in each of driving systems into which the fuel injectors are divided, and current detection circuits that are provided to the driving systems, respectively, and the current detection circuits that sense driving currents of corresponding fuel injectors. The fuel injection control device includes an acquisition unit to acquire a current change parameter that is a parameter correlative to a change quantity of a sensed current per unit time in each of the driving systems, and a current correction unit to execute a current correction in at least one of the driving systems based on the current change parameter in each of the driving systems.

20 Claims, 15 Drawing Sheets

(51) Int. Cl.
*F02D 41/20* (2006.01)
*F02M 51/06* (2006.01)

(52) U.S. Cl.
CPC ..... *F02D 2041/2034* (2013.01); *F02D 2041/2055* (2013.01); *F02D 2041/2058* (2013.01); *F02D 2200/063* (2013.01); *F02M 51/06* (2013.01)

(56) References Cited

U.S. PATENT DOCUMENTS

| | | | | | |
|---|---|---|---|---|---|
| 4,964,014 | A * | 10/1990 | Boe | F02D 41/20 | 361/171 |
| 2015/0144109 | A1 * | 5/2015 | Mukaihara | F02D 41/2467 | 123/490 |
| 2016/0076498 | A1 * | 3/2016 | Aono | F02D 41/2467 | 123/490 |
| 2016/0333812 | A1 * | 11/2016 | Shimatsu | F02M 51/0614 | |
| 2017/0191437 | A1 | 7/2017 | Yanoto | | |
| 2017/0226951 | A1 | 8/2017 | Yanoto | | |

FOREIGN PATENT DOCUMENTS

| | | | | |
|---|---|---|---|---|
| JP | 2010043603 | A * | 2/2010 | |
| JP | 2013-002476 | | 1/2013 | |
| JP | 2013002476 | A * | 1/2013 | |
| WO | WO-2013190995 | A1 * | 12/2013 | F02D 41/2467 |
| WO | WO-2014174916 | A1 * | 10/2014 | F02D 41/20 |
| WO | WO-2014207523 | A2 * | 12/2014 | F02D 41/20 |

* cited by examiner (a) FULLY LIFTING (b) PARTIALLY LIFTING

FUEL INJECTION CONTROL DEVICE FOR INTERNAL COMBUSTION ENGINE

CROSS-REFERENCE TO RELATED APPLICATION

This application is the U.S. national phase of International Application No. PCT/JP2016/082637 filed Nov. 2, 2016, which designated the U.S. and claims priority to Japanese Application No. 2015-233462 filed on Nov. 30, 2015 and Japanese Application No. 2016-158557 filed on Aug. 12, 2016, the entire contents of each of which are incorporated herein by reference.

TECHNICAL FIELD

The present disclosure relates to a fuel injection control device of an internal combustion engine.

BACKGROUND ART

It is known that an electromagnetic solenoid fuel injector is used to supply a fuel to each of cylinders of an internal combustion engine mounted to a vehicle. In the above fuel injector, a fuel injection time point and a fuel injection quantity is controlled by driving a valve (needle) in a valve-opening direction to control an energization time point and an energization time interval of a coil in a main body of the fuel injector.

It is known as a driving technology of the fuel injector that a coil applying voltage is initially a high voltage in a valve-opening state and then switched to a low voltage. In this case, a valve-opening responsivity is improved by an application of the high voltage, and then the fuel injector is driven by a low power by switching to the low voltage. A switching from the high voltage to the low voltage is executed based on a sensed current sensed by a current detection circuit. When it is determined that the sensed current has reached a target peak value that is predetermined, a switching of an applied voltage is executed.

Since a machinery difference exists in a fuel injection device, a variation occurs in an actual driving current. A variation occurs in the fuel injection quantity due to the variation of the driving current. According to Patent Literature 1, a machinery difference quantity of the actual driving current is previously stored in a storage unit, and a target driving current is corrected based on the machinery difference quantity.

PRIOR ART LITERATURES

Patent Literature

Patent Literature 1: JP2014-5740A

SUMMARY OF INVENTION

However, in a multiple-cylinder internal combustion engine, since time intervals of the fuel injections in fuel injectors of each of cylinders overlap each other, it is assumed that plural fuel injectors are divided into plural groups and the fuel injectors in each of the groups are driven. When a driving state of the fuel injector is controlled based on the sensed current of the fuel injector, it is assumed that a current detection circuit is provided to each of the groups. In this case, when a characteristic variation occurs at the current detection circuits of the groups, the driving states of the fuel injectors cannot be evenly controlled, and a variation of the fuel injection quantity may occur. When the driving current of each of the fuel injectors cannot be properly obtained, a variation of the valve-opening responsivity of the fuel injector may occur or a variation of a valve body lifting quantity may occur. Then, it is possible that an excess or a deficiency of the fuel injection quantity occurs. The above matters may be improved.

The present disclosure is made in view of the above matters, and it is an object of the present disclosure to provide a fuel injection control device of an internal combustion engine which can improve an optimization of a driving of a fuel injector and can properly control a fuel injection quantity.

According to the present disclosure, the fuel injection control unit is applied to a fuel injection system of the internal combustion engine, the fuel injection system including fuel injectors, driving circuits that drive the fuel injectors in each of driving systems into which the fuel injectors are divided, and current detection circuits that are provided to each of the driving systems and sense driving currents of corresponding fuel injectors. The fuel injection control device controls driving of the fuel injectors by the driving circuits, based on sensed currents sensed by the current detection circuits. The fuel injection control device includes an acquisition unit to acquire a current change parameter that is a parameter correlative to a change quantity of the sensed current per unit time in each of the driving systems, and a current correction unit to execute a current correction in at least one of the driving systems based on the current change parameter in each of the driving systems.

According to the above configuration, in a fuel injection system that divides plural fuel injectors into plural driving systems and includes the current detection circuit provided to each of the driving groups, the current change parameter that is a parameter correlative to the change quantity of the sensed current per unit time in each of the driving systems is obtained. The current correction of at least one of the driving systems is executed based on the current change parameter. In this case, when injection instructions of the fuel injectors are identical in a case where the characteristic variation occurs at one of the current detection circuits, the current change parameters differ from each other in the driving systems. However, the driving states of the fuel injectors can be controlled to approach each other by executing the current correction based on the current change parameter of each of the driving systems. As a result, the optimization of the driving of the fuel injector can be improved, and the fuel injection quantity can be properly controlled.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

First Embodiment

Figure 1:
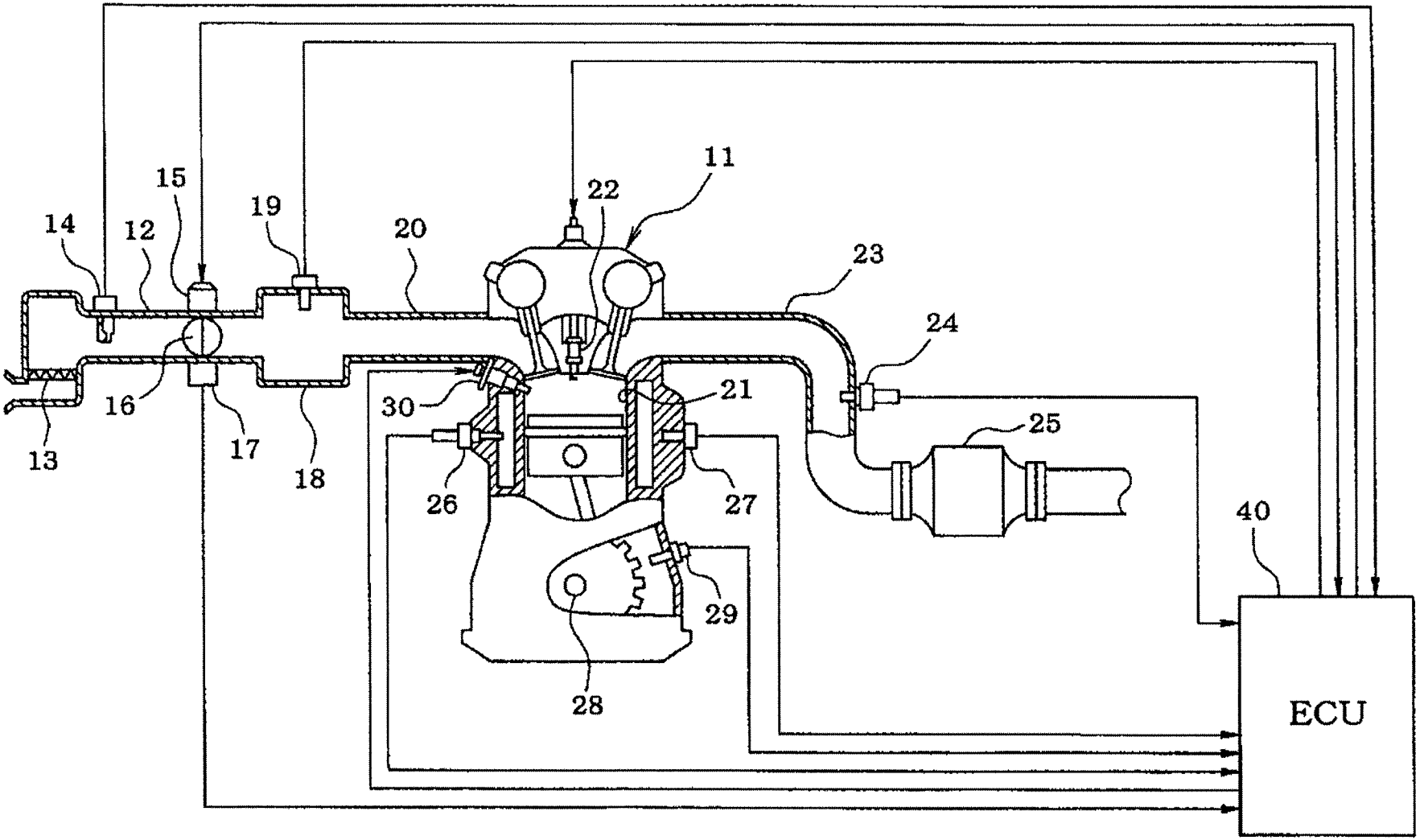
FIG. 1 is a schematic diagram showing an outline of an engine control system.

Hereafter, a first embodiment of the present disclosure will be described referring to drawings. The present embodiment substantiates as a control system that controls a gasoline engine of a vehicle. First, a constitution of an engine control system will be described referring to FIG. 1.

An air cleaner 13 is located at an uppermost stream part of an intake pipe 12 of an engine 11 that is a multi-cylinder internal combustion engine of a cylinder injection type. An air flow meter 14 that senses an intake air quantity is located at a position of the intake pipe 12 downstream of the air cleaner 13. A throttle valve 16 and a throttle opening degree sensor 17 are located at a position of the intake pipe 12 downstream of the air flow meter 14. An opening degree of the throttle valve 16 is adjusted by a motor 15. The throttle opening degree sensor 17 senses the opening degree (throttle opening degree) of the throttle valve 16.

A surge tank 18 is located at a position of the intake pipe 12 downstream of the throttle valve 16. An intake pipe pressure sensor 19 that senses an intake pipe pressure is located at the surge tank 18. An intake gas manifold 20 that introduces an air into each of cylinders 21 of the engine 11 is connected with the surge tank 18. A fuel injector 30 that is an electromagnetic type is mounted to each of the cylinders 21 of the engine 11, and the fuel injector 30 directly injects a fuel into the corresponding cylinder. Ignition plugs 22 corresponding to the cylinders 21 are mounted to a cylinder head of the engine 11. A mixed gas in each of the cylinders 21 is ignited by a spark discharge of the ignition plug 22 of each of the cylinders 21.

An exhaust gas sensor 24 (e.g., air-fuel ratio sensor, oxygen sensor) that senses an air-fuel ratio of the mixed gas or a rich/lean state of the mixed gas based on an exhaust gas is located in an exhaust gas pipe 23 of the engine 11. A catalyst 25 that purifies the exhaust gas such as a three-way catalyst is located at a position of the exhaust gas pipe 23 downstream of the exhaust gas sensor 24.

A coolant temperature sensor 26 that senses a coolant temperature and a knock sensor 27 that senses a knocking are mounted to a cylinder block of the engine 11. A crank angle sensor 29 that outputs a pulse signal every time that the crank shaft 28 rotates at a predetermined crank angle is located at a position around an outer periphery of a crank shaft 28. A crank angle or an engine rotation speed is sensed based on the crank angle signal of the crank angle sensor 29.

Outputs of the above various sensors are transmitted to an ECU 40. The ECU 40 is an electronic control unit mainly constituted by a microcomputer. The ECU 40 executes various controls of the engine 11 by using sensed signals of the various sensors. The ECU 40 calculates a fuel injection quantity according to an engine operation state, controls a fuel injection of the fuel injector 30, and controls an ignition time point of the ignition plug 22.

Figure 2:
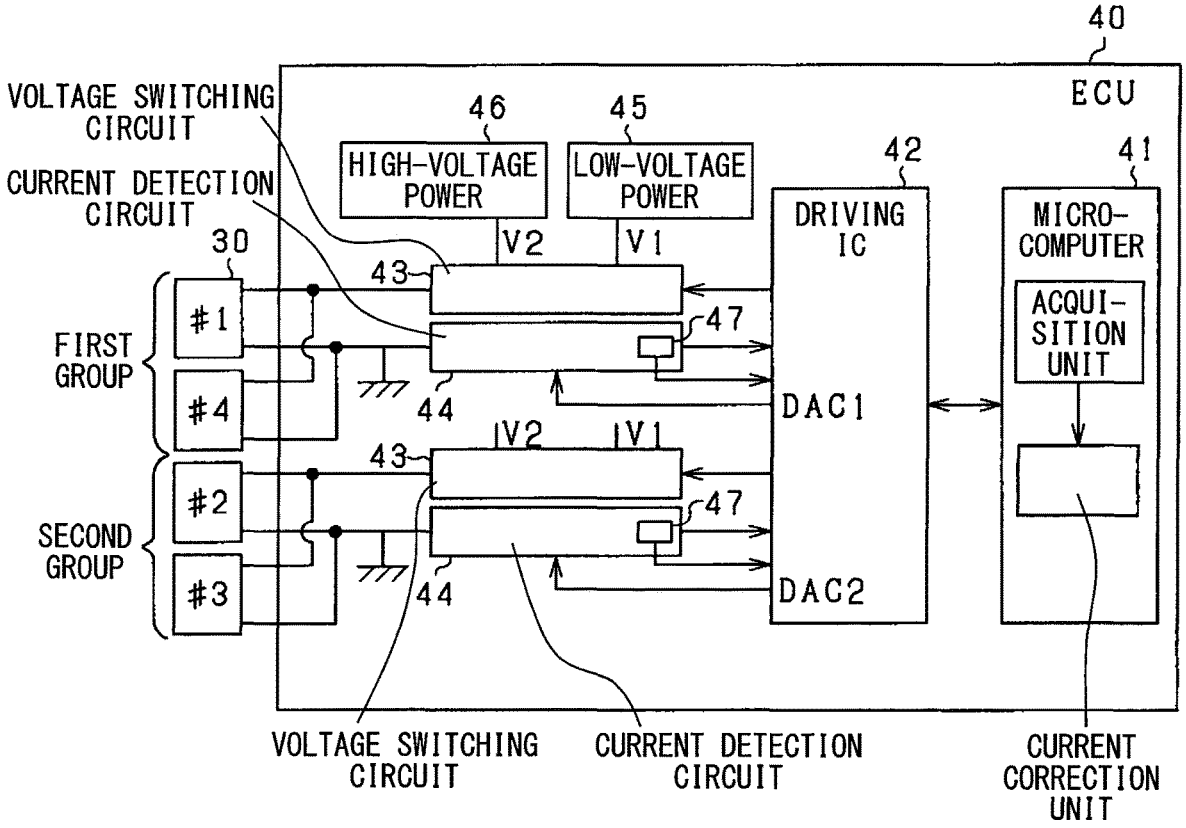
FIG. 2 is a block diagram showing a constitution of an ECU.

As shown in FIG. 2, the ECU 40 includes a microcomputer 41 of an engine control (a microcomputer controlling the engine 11), a driving IC 42 of an injector driving (a driving IC of the fuel injector 30), a voltage switching circuit 43 and a current detection circuit 44. The microcomputer 41 is equivalent to a fuel injection control device. The microcomputer 41 calculates a requested injection quantity according to the engine operation state (e.g., the engine rotation speed or an engine load), generates an injection pulse from an injection time calculated based on the requested injection quantity, and outputs the injection pulse to the driving IC 42. The driving IC 42 and the voltage switching circuit 43 are equivalent to a driving circuit that drives the fuel injector 30 to open by the injection pulse to inject the fuel with the requested injection quantity.

The voltage switching circuit 43 is a circuit that switches a driving voltage applied to the fuel injector 30 of each of the cylinders 21 between a high voltage and a low voltage. Specifically, the voltage switching circuit 43 controls one of a low-voltage power unit 45 and a high-voltage power unit 46 to supply a driving current to a coil of the fuel injector 30 by an on-off operation of a switching element that is not shown. The low-voltage power unit 45 is a low-voltage output circuit that outputs the low voltage V1 such as 12V. The high-voltage power unit 46 is a high-voltage output circuit that outputs the high voltage V2 (boost voltage) such as 60V to 65V. The high-voltage power unit 46 includes a voltage boosting circuit that boosts a battery voltage to the boost voltage.

When the fuel injector 30 is driven by the injection pulse to open, the low voltage V1 and the high voltage V2 are alternatively applied to the fuel injector 30 in time series. In this case, since the high voltage V2 is applied at an initial stage of an opening of the fuel injector 30, a valve-opening responsivity of the fuel injector 30 is ensured. Further, since the low voltage V1 is applied after the initial stage, a valve-opening state of the fuel injector 30 is maintained.

Figure 3:
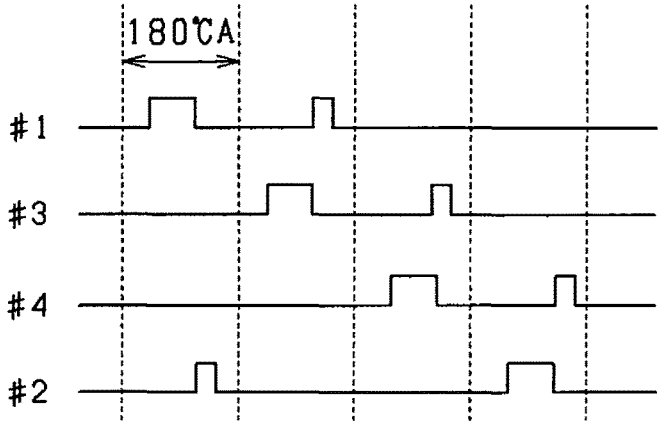
FIG. 3 is a time chart showing a time interval of a fuel injection in each of cylinders.

According to the present embodiment, as shown in FIG. 3, the engine 11 is a four-cylinder engine. A fuel injection that outputs the injection pulse in an intake stroke and the injection pulse in a compression stroke is executed as the fuel injection of the fuel injector 30 of each of the cylinders 21. In addition, the cylinders #1 to #4 have a combustion order that is #1, #3, #4 and #2. In this case, in two cylinders those are next to each other in the combustion order, time intervals of the fuel injections of the fuel injectors 30 may overlap each other.

In the constitution of FIG. 2, two cylinders those are not next to each other are established as a driving group. In this case, a first driving group and a second driving group are established. Further, one voltage switching circuit 43 and one current detection circuit 44 are provided to each of driving groups including the first driving group and the second driving group. In other words, the voltage switching circuit 43 and the current detection circuit 44 of the first driving group execute a voltage switching and a current detection for the fuel injectors 30 of the cylinders #1 and #4, and the voltage switching circuit 43 and the current detection circuit 44 of the second driving group execute the voltage switching and the current detection for the fuel injectors 30 of the cylinders #2 and #3. Thus, each of the fuel injectors 30 is driven by a driving system of each of the driving groups.

The current detection circuit 44 senses an energization current in a valve-opening driving of the fuel injector 30 and successively outputs a sensed result to the driving IC 42. The current detection circuit 44 may have a known constitution. For example, the current detection circuit 44 may include a shunt resistance and a comparator. DAC ports (DAC1, DAC2) of the driving IC 42 output a reference signal equivalent to a reference current. The comparator of the current detection circuit 44 outputs a comparison result of the driving current of each of the fuel injector 30 and the reference current.

A temperature sensor 47 is located at each of the current detection circuits 44. The temperature sensor 47 senses a temperature of each of the current detection circuits 44. It can be assumed that an affection level of a heat receiving from other heat generation sources or a level of a heat dissipation in each of the current detection circuits 44 differs according to an arrangement of each of the current detection circuits 44 in a housing of the ECU 40. When a temperature difference occurs between the current detection circuits 44, the temperature sensors 47 sense the temperature difference.

Figure 4:
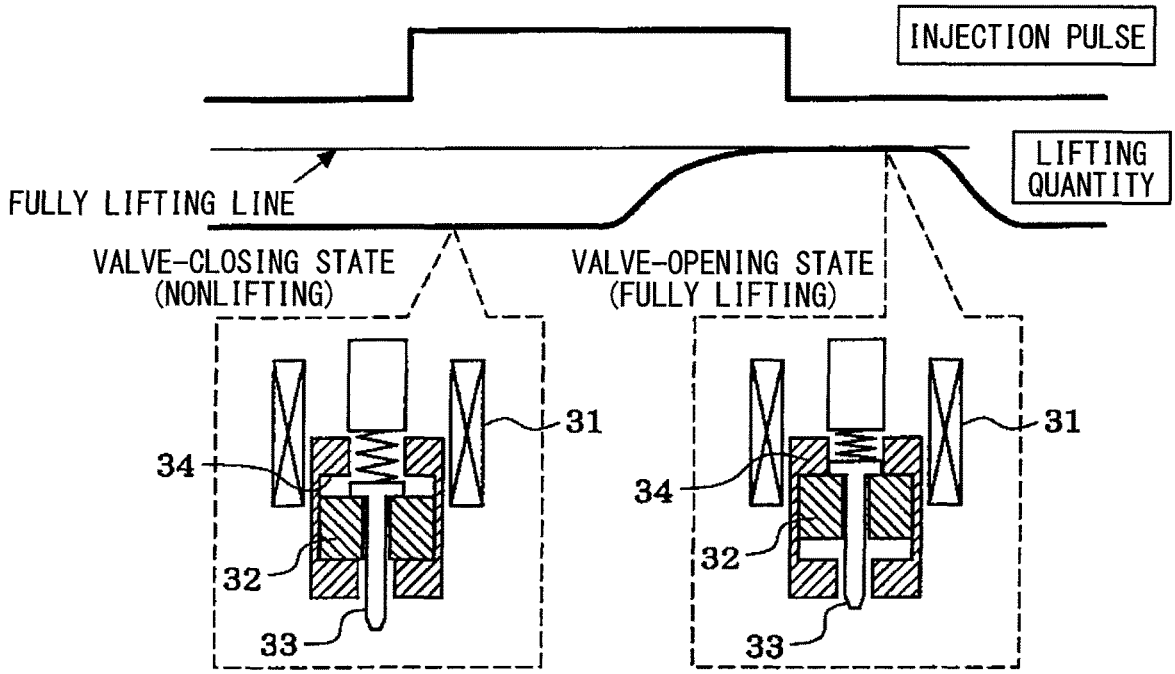
FIG. 4*a* and FIG. 4*b* are diagrams showing a constitution of the fuel injector and state of the fuel injector.
Figure 4:
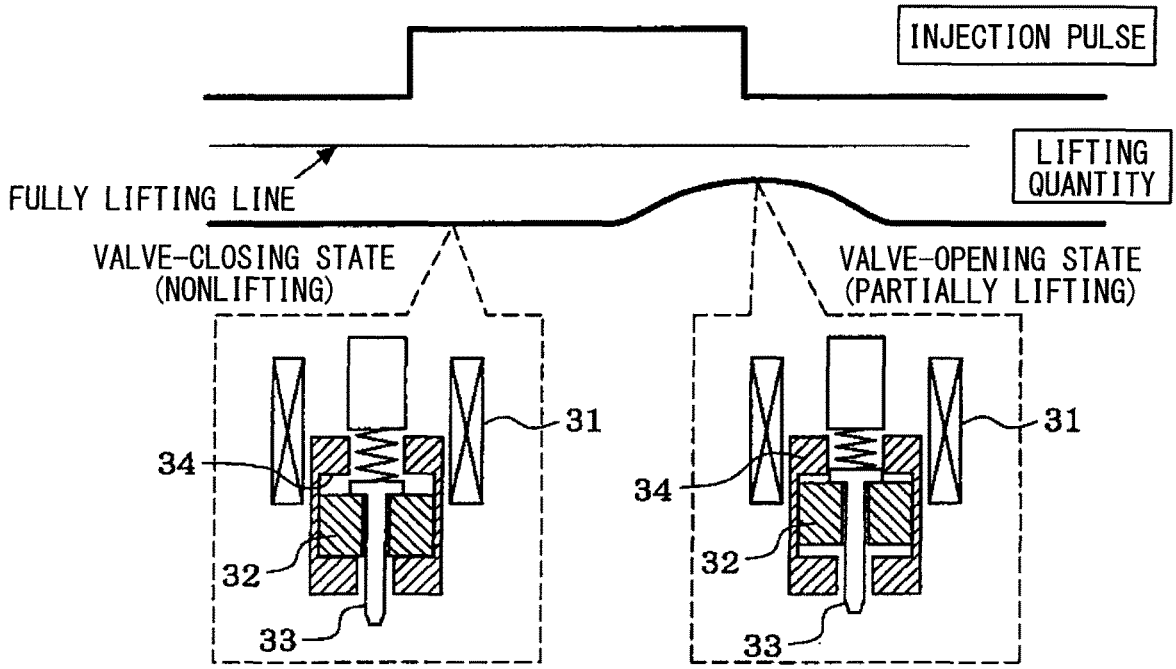

According to the present embodiment, in a driving mode of the fuel injector 30, a lifting of a valve body of the fuel injector 30 is stopped in a partially lifting state before the valve body reaches a fully lifting position, and a partially lifting injection that injects the fuel with a required quantity at the partially lifting state is executed. Referring to FIG. 4, the partially lifting injection will be briefly described. In addition, FIG. 4(*a*) indicates an operation in a fully lifting injection, and FIG. 4(*b*) indicates an operation in the partially lifting injection.

As shown in FIG. 4, the fuel injector 30 includes a coil 31 that generates an electromagnetic force when being energized and a needle 33 (valve body) that is driven integrally with a plunger 32 (movable core) by the electromagnetic force. When the needle 33 moves to a valve-opening position, the fuel injector 30 becomes in the valve-opening state, and the fuel injection is executed. Time intervals (energization time intervals) of injection pulses in FIGS. 4(*a*) and 4(*b*) differ from each other. When an injection pulse width becomes relatively longer (when a needle lifting quantity becomes the fully lifting quantity) as shown in FIG. 4(*a*), the needle 33 reaches the fully lifting position (a position where the plunger 32 becomes in contact with a stopper 34). When the injection pulse width becomes relatively shorter (when the needle lifting quantity becomes the partially lifting quantity) as shown in FIG. 4(*b*), the needle 33 becomes in the partially lifting state (a state before the plunger 32 becomes in contact with the stopper 34) where the needle 33 does not reach the fully lifting position. When an energization of the coil 31 is stopped in response to a falling of the injection pulse, the plunger 32 and the needle 33 return to a valve-closing position. In this case, the fuel injector 30 becomes in a valve-closing state, and the fuel injection is stopped.

Figure 5:
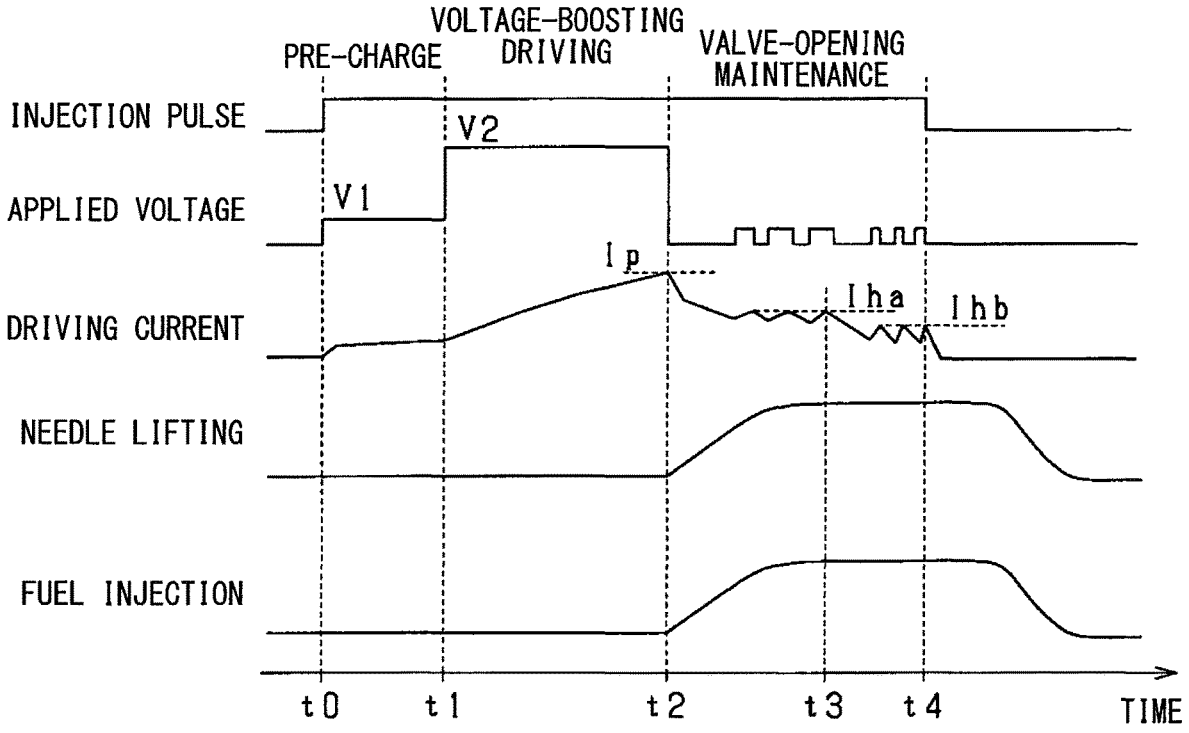
FIG. 5 is a time chart showing a driving operation of the fuel injector.

Next, referring to FIG. 5, a driving operation of the fuel injector 30 executed based on the injection pulse by the driving IC 42 and the voltage switching circuit 43 will be detailed. According to the present embodiment, a pre-charge, a voltage-boosting driving and a valve-opening maintaining driving are sequentially executed in a time interval where the injection pulse is turned on. In the pre-charge, a low voltage (according to the present embodiment, a low voltage V1) that the fuel injector 30 does not open is applied to the fuel injector 30 before an application of a high voltage V2, in an energization start state of the fuel injector 30. A reaching time interval necessary for the driving current to reach a target peak value is shortened. In the voltage-boosting driving, the high voltage V2 is applied to the fuel injector 30 in a voltage-boosting driving time interval to improve the valve-opening responsivity. In the valve-opening maintaining driving, the low voltage V1 is applied to the fuel injector 30 after the voltage-boosting driving is executed.

As shown in FIG. 5, at a time point t0, the injection pulse is turned on. In a time interval from the time point t0 to a time point t1, the pre-charge is executed by using the low voltage V1. In a pre-charge time interval, the pre-charge is stopped based on a phenomenon that a sensed current sensed by the current detection circuit 44 reaches a predetermined value. In addition, the pre-charger time interval may be a time interval that is previously determined. Alternatively, the pre-charge may be executed by repeatedly turning on and turning off the switching element in the voltage switching circuit 43 at a predetermined duty ratio.

At the time point t1, an applied voltage of the fuel injector 30 is switched from the low voltage V1 to the high voltage V2. Thus, the driving current is more sharply increased in a voltage boosting time interval from the time point t1 to a time point t2 than that in the time interval from the time point t0 to the time point t1. Then, at the time point t2, when the driving current reaches the target peak value Ip that is previously determined, the application of the high voltage V2 is stopped. In this case, a needle lifting starts at a timing that the driving current reaches the target peak value Ip or at a timing right before the driving current reaches the target peak value Ip, and the fuel injection starts in response to the needle lifting. A determination whether the driving current has reached the target peak value Ip is executed based on the sensed current sensed by the current detection circuit 44. In other words, it is determined whether the sensed current is greater than or equal to Ip at the driving IC 42 in the voltage boosting time interval (t1 to t2). At a time point that the sensed current is greater than or equal to Ip, the voltage switching circuit 43 executes a switching of the applied voltage (V2 application stop).

After the time point t2, the driving current decreases in response to an application stop of the high voltage V2, and the low voltage V1 is intermittently applied to the fuel injector 30 based on a current threshold that is previously determined and the sensed current sensed by the current detection circuit 44. As shown in FIG. 5, a target holding value Ih for a valve-opening maintenance is established at two levels including a target holding value Iha and a target holding value Ihb. In a time interval from the time point t2 to a time point t3, an application of the low voltage V1 is executed based on the target holding value Iha. In a time interval from the time point t3 to a time point t4, the application of the low voltage V1 is executed based on the target holding value Ihb (less than Iha). In the time interval from the time point t2 to the time point t3, the target holding value Iha is previously set to have a hysteresis and include two values those are a high value and a low value. When the sensed current reaches the low value of Iha, a voltage application is turned on. When the sensed current reaches the high value of Ihb, the voltage application is turned off. In the time interval from the time point t3 to the time point t4, the target holding value Ihb is previously set to have a hysteresis and include two values those are a high value and a low value. When the sensed current reaches the low value of Ihb, the voltage application is turned on. When the sensed current reaches the high value of Ihb, the voltage application is turned off. Switchings of the target holding values Iha, Ihb (high-to-low switching) may be executed at a timing (the time point t3 shown in FIG. 5) that the needle lifting becomes the partially lifting quantity that is predetermined.

Then, when the injection pulse is turned off at the time point t4, the voltage application of the fuel injector 30 is stopped, and the driving current becomes zero. The needle lifting is stopped in response to a stop of a coil energization of the fuel injector 30, and the fuel injection is stopped according to the stop of the coil energization.

In the valve-opening driving of the fuel injector 30, the switching of the applied voltage is executed based on the sensed result of the driving current, that is, the switching of the applied voltage is executed based on a driving profile, as the above description. However, it is possible that an error is included in the sensed current at the current detection circuit 44 due to various factors. For example, it is possible that a detection error occurs due to an individual difference of a shunt resistance or an aging deterioration of the shut resistance. In this case, when an error is included in the sensed current relative to an actual driving current (actual current), a timing that the driving current reaches the target peak value Ip cannot be properly obtained, and it is possible that an excess or a deficiency of the fuel injection quantity occurs as a result.

According to the present embodiment, since plural current detection circuits 44 are provided to each of the driving groups (driving systems), it is possible that a characteristic variation of each of the current detection circuits 44 occurs to be different from each other. In this case, a variation of the fuel injection quantity of each of the cylinders due to the characteristic variation of each of the current detection circuits 44, and it is possible that a torque variation occurs as a result.

Figure 6:
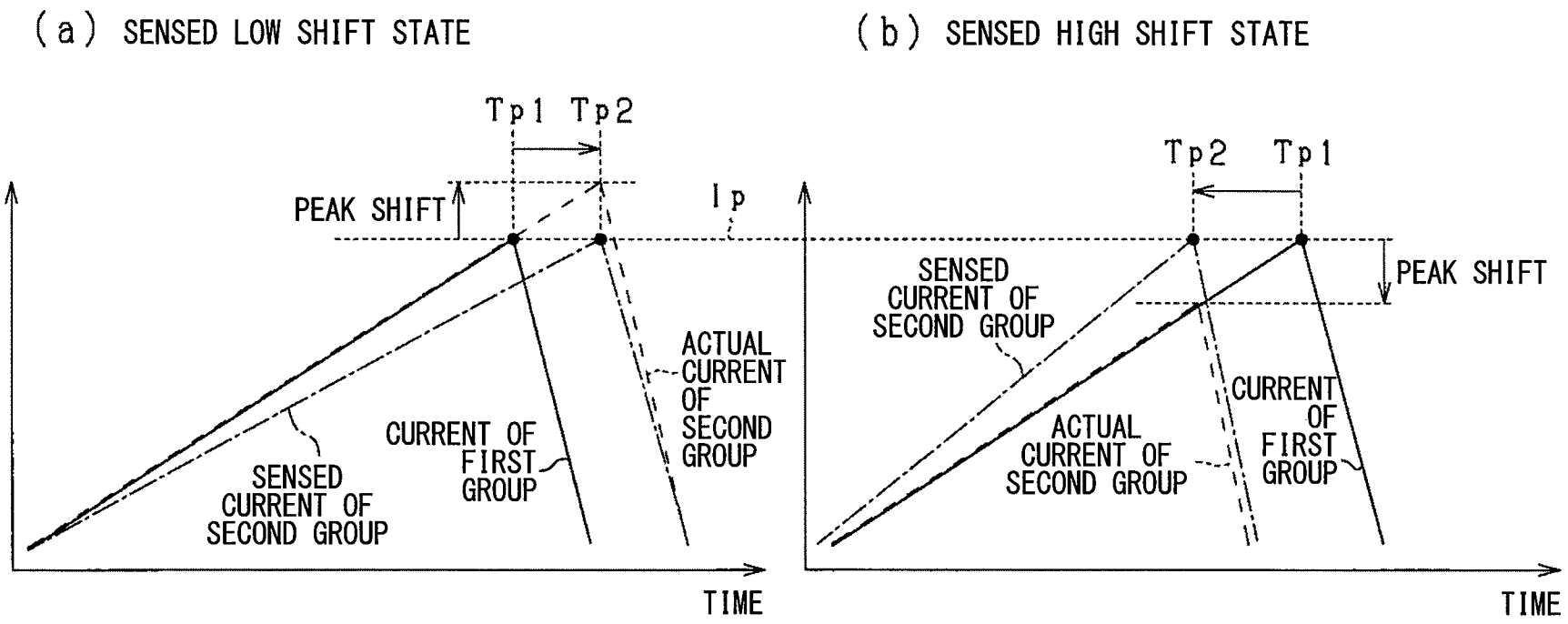
FIG. 6*a* and FIG. 6*b* are time charts showing a detection shift of a current detection circuit.

Referring to FIG. 6, the characteristic of each of the current detection circuit 44 will be described. In this case, a circumstance that a detection shift occurs only at the current detection circuit 44 of the second driving group between the current detection circuits 44 of the first driving group and the second driving group is indicated. As shown in FIG. 6, a solid line indicates the sensed current of the current detection circuit 44 of the first driving group and matches the driving current (actual current) that actually flows through the fuel injector 30. A dotted-dashed line indicates the sensed current of the current detection circuit 44 of the second driving group, and a dashed line indicates the actual current that flows through the fuel injector 30 of the second driving group.

FIG. 6(*a*) indicates a circumstance that the current detection circuit 44 of the second group senses the driving current to be lower than the actual current, and FIG. 6(*b*) indicates a circumstance that the current detection circuit 44 of the second group senses the driving current to be higher than the actual current. In other words, a sensed gain in FIG. 6(*a*) is low, and the sensed gain in FIG. 6(*b*) is high.

As shown in FIG. 6(*a*), in the first driving group, the detection shift of the current detection circuit 44 does not occur and both the sensed current and the actual current vary as the solid line. In this case, the reaching time interval necessary for the sensed current to reach the target peak value Ip is obtained as Tp1. In the second driving group, a low current shift that is a shift of the sensed current (dotted-dashed line) relative to the actual current (dashed line) occurs due to the detection shift of the current detection circuit 44. In this case, the reaching time interval necessary for the sensed current to reach the target peak value Ip is obtained as Tp2. Since the reaching time interval Tp2 of the second driving group is longer than the reaching time interval Tp1 of the first driving group, the actual current of the second driving group increases to a high current value that is higher than the target peak value Ip.

In each of the driving groups, the switching (V1 application stop) of the applied voltage is executed at a timing that the sensed current of the fuel injector 30 reaches the target peak value Ip. In this case, since the timings of voltage switchings at the driving groups actually differ from each other, it is possible that a difference occurs in fuel injection quantities as a result. That is, in the second driving group, since a voltage boosting energy in the voltage-boosting driving time interval is greater than that in the first driving group and a needle lifting operation becomes greater than that in the first driving group, it is possible that the fuel injection quantity becomes excessive.

As shown in FIG. 6(*b*), in the first driving group, the same as the first driving group shown in FIG. 6(*a*), the detection shift of the current detection circuit 44 does not occur and both the sensed current and the actual current vary as the solid line. In this case, the reaching time interval necessary for the sensed current to reach the target peak value Ip is obtained as Tp1. In the second driving group, a high current shift that is a shift of the sensed current (dotted-dashed line) relative to the actual current (dashed line) occurs due to the detection shift of the current detection circuit 44. In this case, the reaching time interval necessary for the sensed current to reach the target peak value Ip is obtained as Tp2. Since the reaching time interval Tp2 of the second driving group is shorter than the reaching time interval Tp1 of the first driving group, the actual current of the second driving group increases to a low current value that is lower than the target peak value Ip.

In each of the driving groups, the switching (V1 application stop) of the applied voltage is executed at a timing that the sensed current of the fuel injector 30 reaches the target peak value Ip. In this case, since the timings of the voltage switchings at the driving groups actually differ from each other, it is possible that the difference occurs in the fuel injection quantities as a result, the same as those in FIG. 6(*a*). That is, in the second driving group, since the voltage boosting energy in the voltage-boosting driving time interval is less than that in the first driving group and the needle lifting operation becomes less than that in the first driving group, it is possible that the fuel injection quantity becomes deficient.

FIG. 6 indicates a circumstance that the detection shift occurs only at the current detection circuit 44 of the second driving group between the current detection circuits 44 of the first driving group and the second driving group. When the detection shifts differ from each other in a case where the detection shifts occur at the current detection circuits 44, it is possible that a peak shift that is equivalent to the low current shift or the high current shift occurs.

When the detection shift occurs as the above description, a shift of the driving current in a valve-opening maintenance time interval occurs due to the detection shift. Therefore, it is possible that the shift affects a driving state (e.g., needle lifting quantity) of the fuel injector 30 in the valve-opening maintenance time interval.

According to the present embodiment, the microcomputer 41 measures the reaching time interval from a reference timing that is predetermined to a timing that the sensed current reaches a predetermined current value in each of the fuel injections of the fuel injectors 30, based on the detection currents obtained by the current detection circuits 44 of the first driving group and the second driving group. The microcomputer 41 executes a current correction of each of the driving groups those are the first driving group and the second driving group based on a difference between the reaching time intervals of the current detection circuits 44. According to the present embodiment, the reaching time interval of each of the current detection circuits 44 is equivalent to a current change parameter. The microcomputer 41 is equivalent to an acquisition unit and a current correction unit.

Specifically, the microcomputer 41 sets a timing (time point t1 shown in FIG. 5) that the pre-charge is completed after the injection pulse is turned on and the application of the high voltage V2 starts as the reference timing. The microcomputer 41 measures a time interval from the reference timing to a timing that the sensed current reaches the target peak value Ip as a peak current reaching time interval Tp. When the microcomputer 41 determines that a difference ΔTp between the peak current reaching time intervals Tp of the driving groups those are the first driving group and the second driving group is greater than or equal to a predetermined value, the microcomputer 41 executes a correction of the target peak value Ip to uniform the peak current reaching time intervals Tp of the driving groups those are the first driving group and the second driving group. In this case, in the first driving group and the second driving group, the target peak values Ip that differ from each other according to the detection variations are set.

The microcomputer 41 can set a timing in a time interval (t1 to t2 shown in FIG. 5) where the application of the high voltage V2 is executed after the pre-charge is completed as the reference timing instead of the timing that the pre-charge is completed after the injection pulse is turned on and the application of the high voltage V2 starts, to measure the peak current reaching time interval Tp. The microcomputer 41 may uniform the peak current reaching time intervals Tp of the driving groups those are the first driving group and the second driving group by controlling the peak current reaching time intervals Tp to be in a predetermined range.

Figure 7:
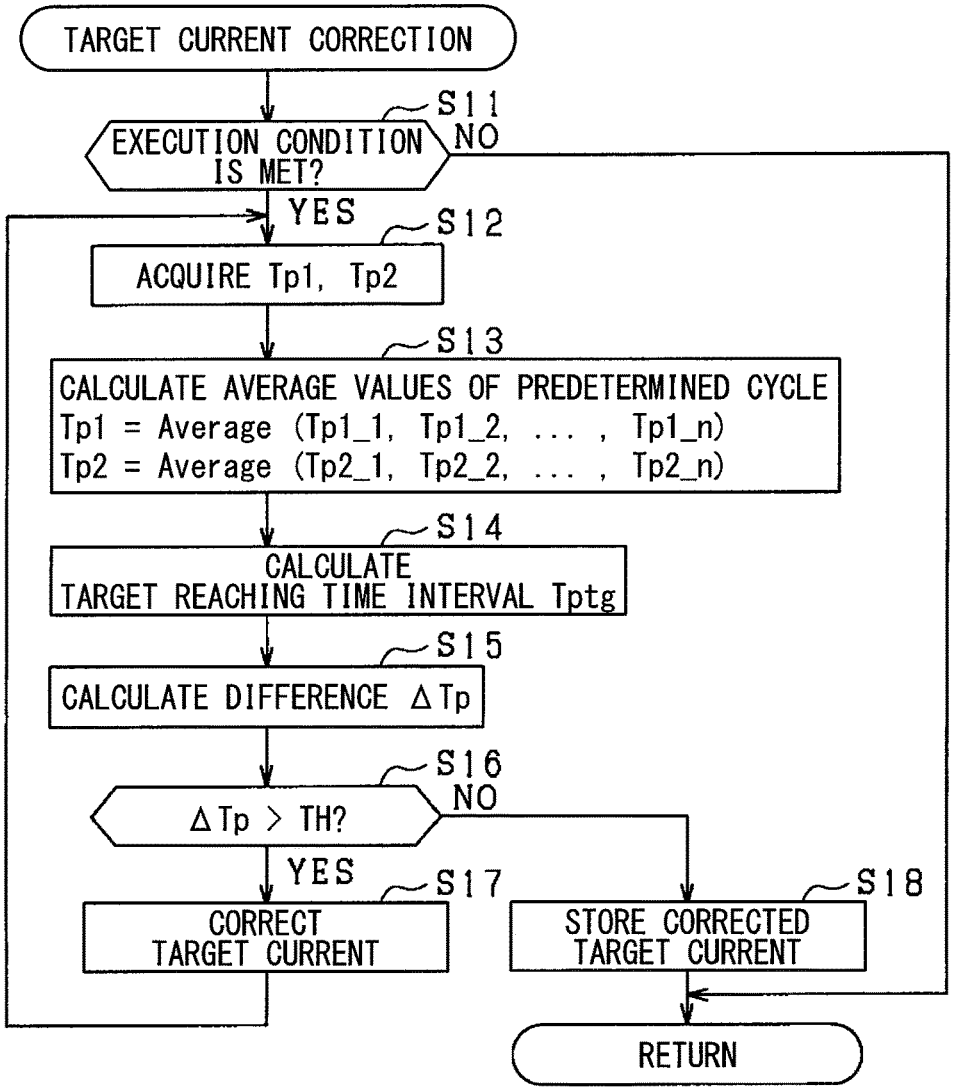
FIG. 7 is a flowchart showing a procedure of a target current correction operation.

FIG. 7 is a flowchart showing a procedure of a target current correction operation. The microcomputer 41 repeatedly executes the present operation at a predetermined cycle. According to the present embodiment, the microcomputer 41 executes a correction of the target peak value Ip and a correction of the target holding value Ih as a correction of a target current value.

As shown in FIG. 7, at step S11, the microcomputer 41 determines whether an execution condition of a correction logic is met. The execution condition includes a condition that the engine 11 or the vehicle operates at a steady state. Specifically, the execution condition includes a condition that a variation of each of parameters including an engine rotation speed, an engine coolant temperature, a load and a vehicle speed is less than or equal to a predetermined value. According to the present embodiment, the execution condition includes a condition that the engine operation state is the steady state and a condition that the engine operation state is a predetermined state other than an idling reduction state (i.e., a state other than a slight injection state that the fuel injection quantity of one driving of the fuel injector 30 is less than a predetermined value).

Then, at step S12, the microcomputer 41 acquires the peak current reaching time interval Tp1 of the first driving group and the peak current reaching time interval Tp2 of the second driving group. The peak current reaching time interval Tp1 and the peak current reaching time interval Tp2 are acquired in driving of the fuel injectors 30 of the driving groups including the first driving group and the second driving group. At step S12, the microcomputer 41 may execute a temperature correction based on a temperature of each of the current detection circuits 44 for the peak current reaching time intervals Tp1 and Tp2 those are acquired. In other words, the microcomputer 41 acquires the temperature difference of the current detection circuits 44 based on sensed temperatures obtained by temperature sensors 47 of the current detection circuits 44, and corrects the peak current reaching time intervals Tp1 and Tp2 based on the temperature difference. In this case, the microcomputer 41 sets one of sensed temperatures of the driving groups those are the first driving group and the second driving group as a reference temperature, and corrects to increase or decrease the peak current reaching time interval based on the temperature difference.

Then, at step S13, the microcomputer 41 calculates the peak current reaching time interval of each of the driving groups those are the first driving group and the second driving group, by using an average value of the peak current reaching time intervals in a predetermined sampling number n. For example, n is equal to 20.

Then, at step S14, the microcomputer 41 calculates a target reaching time interval Tptg. In this case, the microcomputer 41 uses the larger one of the reaching time intervals Tp1 and Tp2 of the driving groups those are the first driving group and the second driving group as the target reaching time interval Tptg. Alternatively, the microcomputer 41 can also use the smaller one of the reaching time intervals Tp1 and Tp2 of the driving groups those are the first driving group and the second driving group as the target reaching time interval Tptg.

When the reaching time intervals Tp1 and Tp2 are large, change quantities of the sensed currents per unit time are small. When the larger one of the reaching time intervals Tp1 and Tp2 is set as the target reaching time interval Tptg, the smaller one of change quantities of the sensed currents per unit time is set as a reference of the reaching time interval (current control). In this case, the reaching time interval of a system that the change quantity of the sensed current per unit time is large (a system that the reaching time interval is small) is controlled to be fit to a system that the change quantity of the sensed current per unit time is small (a system that the reaching time interval is large).

When the reaching time intervals Tp1 and Tp2 are small, the change quantities of the sensed currents pre unit time are large. When the smaller one of the reaching time intervals Tp1 and Tp2 is set as the target reaching time interval Tptg, the larger one of the change quantities of the sensed currents per unit time is set as the reference of the reaching time interval (current control). In this case, the reaching time interval of a system that the change quantity of the sensed current per unit time is small (a system that the reaching time interval is large) is controlled to be fit to a system that the change quantity of the sensed current per unit time is large (a system that the reaching time interval is small).

Then, at step S15, the microcomputer 41 calculates a difference ΔTp between the target reaching time interval Tptg and a correction subject that is one of the reaching time intervals Tp1 and Tp2 of the driving groups including the first driving group and the second driving group. For example, when the microcomputer 41 selects the larger one of the reaching time intervals Tp1 and Tp2 as the target reaching time interval Tptg at step S14, the microcomputer 41 calculates the difference ΔTp between the target reaching time interval Tptg and the correction subject that is the smaller one of the reaching time intervals.

Figure 8:
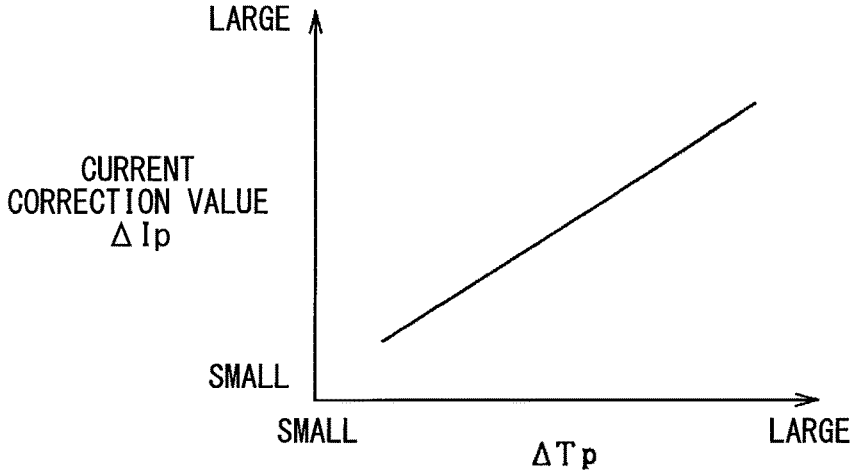
FIG. 8 is a graph showing a relationship between a difference ΔTp of reaching time intervals and a current correction value ΔIp.

Then, at step S16, the microcomputer 41 determines whether the difference ΔTp is greater than a threshold TH that is predetermined. When the microcomputer 41 determines that ΔTp is greater than TH, the microcomputer 41 proceeds to step S17. At step S17, the microcomputer 41 executes a correction of a target current. In this case, the microcomputer 41 executes a correction of the target peak value Ip in the voltage-boosting driving time interval for the correction subject that is one of the driving groups including the first driving group and the second driving group. Specifically, the microcomputer 41 calculates a current correction value ΔIp based on the difference ΔTp by using a relationship shown in FIG. 8. According to the relationship in FIG. 8, the microcomputer 41 calculates a value that increases in accordance with an increase in difference ΔTp, as the current correction value ΔIp. Then, the microcomputer 41 corrects one of the target peak values Ip1 and Ip2 of the driving groups including the first driving group and the second driving group which is necessary to be corrected, by the current correction value ΔIp (Ipx=Ipx+ΔIp). Thus, the target peak value Ip is corrected to uniform the peak current reaching time intervals Tp of the driving groups those are the first driving group and the second driving group, and Ip1 is not equal to Ip2.

At step S17, the microcomputer 41 executes a correction of the target holding value Ih in the valve-opening maintenance time interval in addition of the correction of the target peak value Ip in the voltage-boosting driving time interval. In this case, the target holding value Ih is lower than the target peak value Ip. The microcomputer 41 corrects the target holding value Ih of the respective driving group relative to that in the correction of the target peak value Ip, based on ratios (shifts of Ip1 and Ip2) of the target peak values Ip1 and Ip2 of the driving groups including the first driving group and the second driving group. For example, when the microcomputer 41 corrects the target holding value Ih2 of the second driving group in a case where the target holding value Ih1 of the first driving group is used as the reference, the microcomputer 41 corrects the target holding value Ih2 by an equation that Ih2=Ih1×(Ip2/Ip1). When the target holding value Ih in the valve-opening maintenance time interval is set at plural levels, the microcomputer 41 corrects the target holding value Ih at each of the levels.

The microcomputer 41 returns to step S12 after executing the correction of the target current. The microcomputer 41 repeatedly executes steps S12 to S17 until the microcomputer 41 determines that the difference ΔTp is less than or equal to the threshold TH at step S16 (S16 is NO).

When the microcomputer 41 determines that the difference ΔTp is less than or equal to the threshold TH at step S16, the microcomputer 41 proceeds to step S18. At step S18, when the microcomputer 41 has executed the current correction in the present correction operation, the microcomputer 41 stores a correction result of the current correction. In other words, the microcomputer 41 stores the target peak value Ip and the target holding value Ih those are corrected in a backup memory (e.g., EEPROM). The target peak value Ip and the target holding value Ih those are corrected are stored as learning values and are loaded in a driving of the fuel injector 30.

Figure 9:
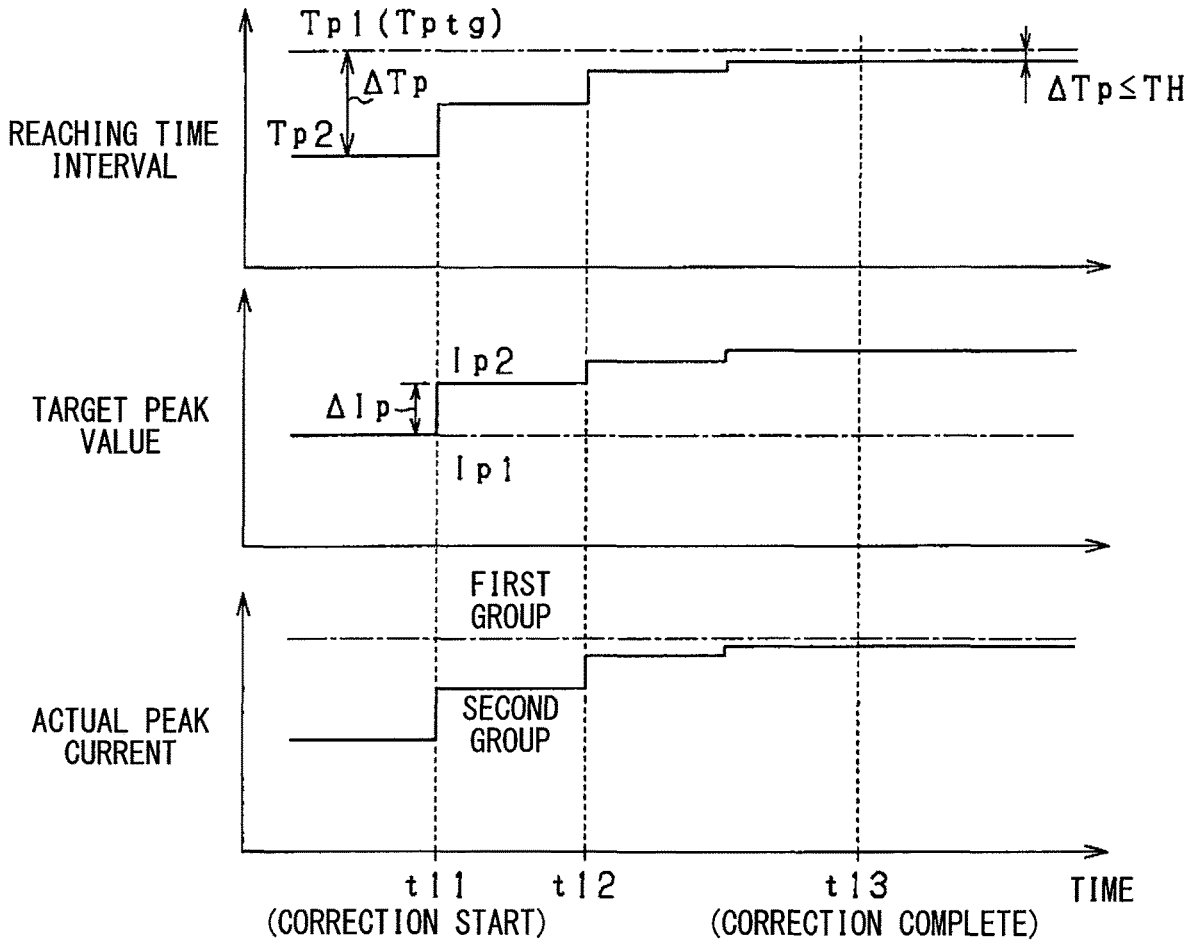
FIG. 9 is a time chart showing a peak current correction.
Figure 10:
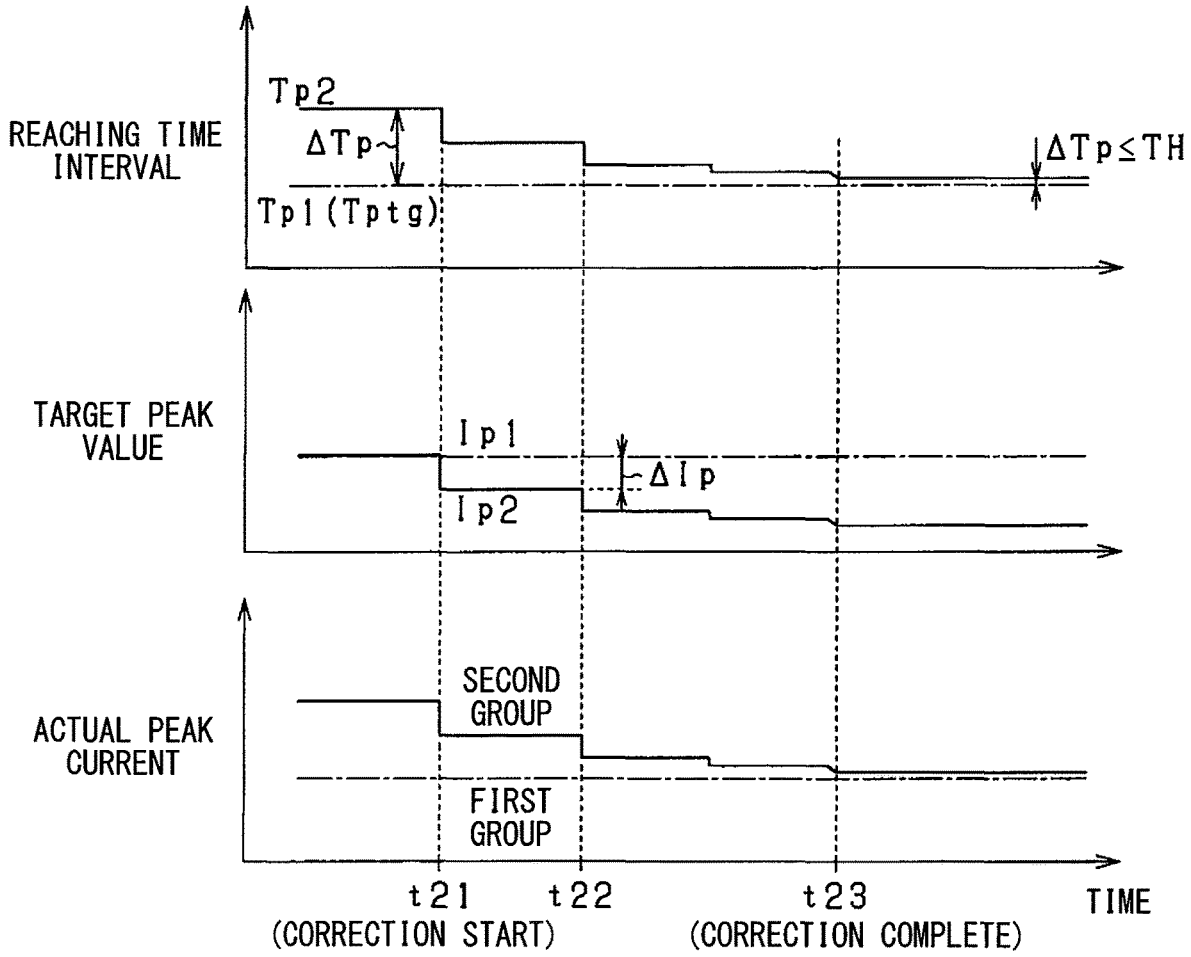
FIG. 10 is a time chart showing the peak current correction.

FIG. 9 and FIG. 10 are time charts showing specifications of the correction operation of the target current. In this case, the correction operation of the target peak value Ip of the driving groups including the first driving groups and the second driving groups. As shown in FIG. 9, the reaching time interval of the first driving group is the larger one in the driving groups including the first driving group and the second driving group, the reaching time interval Tp1 of the first driving group is set as the reference, and the reaching time interval Tp2 are adjusted. As shown in FIG. 10, the reaching time interval of the first driving group is the smaller one in the diving groups including the first driving group and the second driving group, the reaching time interval Tp1 of the first driving group is set as the reference, and the reaching time interval Tp2 of the second driving group is adjusted.

As shown in FIG. 9, the reaching time intervals Tp1 and Tp2 necessary for the sensed currents to reach the target peak value Ip in the driving groups including the first driving group and the second driving group are obtained, before a time point t11. In this case, the reaching time intervals in the driving groups including the first driving group and the second driving group differ from each other. The reaching time interval Tp1 of the first driving group is greater than the reaching time interval Tp2 of the second driving group. Thus, the larger one of the reaching time intervals that is the reaching time interval Tp1 of the first driving group is set as the reference, and an adjustment (extension) of the reaching time interval Tp2 of the second driving group is executed, after the time point t11.

At the time point t11, the difference ΔTp is calculated by subtracting the reaching time interval Tp2 of the second driving group from the reaching time interval Tp1 (equivalent to Tptg) of the first driving group, and the current correction value ΔIp is calculated based on the difference ΔTp. The target peak value Ip2 of the second driving group is corrected by the current correction value ΔIp.

In a time interval from the time point t11 to a time point t12, the reaching time intervals Tp1 and Tp2 of the driving groups including the first driving group and the second driving group are obtained again, by using the target peak value Ip1 of the first driving group that is not corrected and the target peak value Ip2 of the second driving group that is corrected. At the time point t12, the current correction valve ΔIp are calculated again, based on the difference ΔTp of the reaching time intervals, and the target peak value Ip2 of the second driving group is corrected by the current correction value ΔIp. The correction of the target peak value Ip2 is repeatedly executed in a case where a condition that the difference ΔTp is greater than the threshold TH is met. At the time points t11 and t12, the current correction value ΔIp gradually decreases in accordance with a gradual decrease in difference ΔTp.

Then, at a time point t13, when the difference ΔTp is determined to be less than or equal to the threshold TH, the correction of the target peak value Ip2 is stopped. At the time point t13, actual peak currents of the driving groups including the first driving group and the second driving group are substantially equal to each other, and then the variations of the fuel injection quantities between the cylinders are canceled.

As shown in FIG. 10, the reaching time interval Tp1 of the first driving group is less than the reaching time interval Tp2 of the second driving group, before a time point t21. Thus, the smaller one of the reaching time intervals that is the reaching time interval Tp1 of the first driving group is set as the reference, and the adjustment (contraction) of the reaching time interval Tp2 of the second driving group is executed, after the time point t21.

At the time point t21, the difference ΔTp is calculated by subtracting the reaching time interval Tp2 of the second driving group from the reaching time interval Tp1 (equivalent to Tptg) of the first driving group, and the current correction value ΔIp is calculated based on the difference ΔTp. The target peak value Ip2 of the second driving group is corrected by the current correction value ΔIp.

Then, in a time interval from the time point t21 to a time point t22, the reaching time intervals Tp1 and Tp2 of the driving groups including the first driving group and the second driving group are obtained again, by using the target peak value Ip1 of the first driving group that is not corrected and the target peak value Ip2 of the second driving group that is corrected. At the time point t22, the current correction value ΔIp is calculated again based on the difference ΔTp of the reaching time intervals, and the target peak value Ip2 of the second driving group is corrected by the current correction value ΔIp. The correction of the target peak value Ip2 is repeatedly executed in a case where a condition that the difference ΔTp is greater than the threshold TH is met. At the time points t21 and t22, the current correction value ΔIp gradually decreases in accordance with a gradual decrease in difference ΔTp.

Then, at a time point t23, the difference ΔTp is determined to be less than or equal to the threshold TH, and the correction of the target peak value Ip2 is stopped. At the time point t23, the actual peak currents of the driving groups including the first driving group and the second driving group are substantially equal to each other, and the variations of the fuel injection quantities between the cylinders are canceled.

Figure 11:
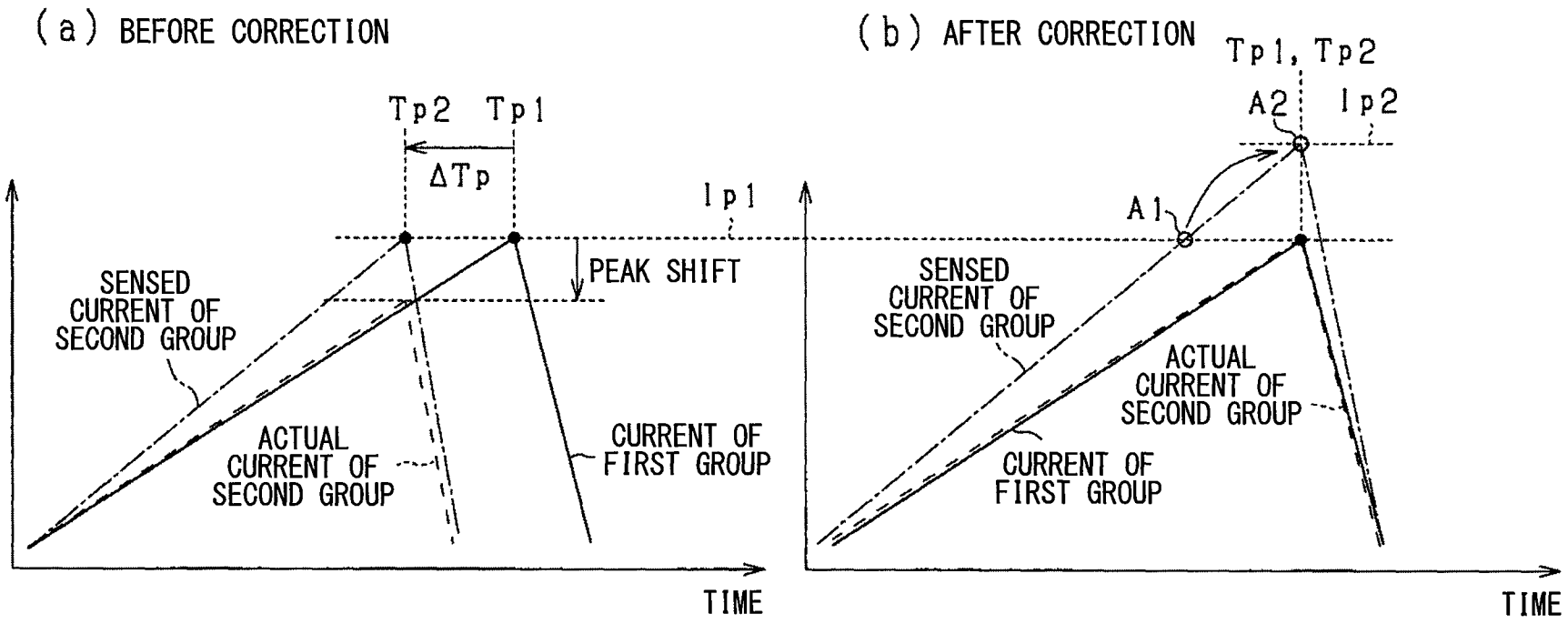
FIGS. 11*a* and 11*b* are time charts showing the peak current correction.

FIG. 11 is a supplement diagram showing the correction of the target peak value Ip. As shown in FIG. 11, when the driving current is detected to be greater than the actual current in the current detection circuit 44 of the second driving group, the target peak value Ip1 of the first driving group is set as the reference, the adjustment of the target peak value Ip2 of the second driving group is executed. In this case, the reaching time interval of a system that the change quantity of the sensed current per unit time is large (a system that the reaching time interval is small) is controlled to be fit to a system that the change quantity of the sensed current per unit time is small (a system that the reaching time interval is large). In addition, FIG. 11(*a*) shows the same situation as FIG. 6(*b*).

As shown in FIG. 11(*a*), in the second driving group, the high current shift of the sensed current occurs due to the detection shift of the current detection circuit 44. In this case, the peak current reaching time interval Tp2 of the second driving group is less than the peak current reaching time interval Tp1 of the first driving group.

In this case, according to the above correction operation, the target peak value Ip2 of the second driving group is corrected to increase based on the difference ΔTp of the peak current reaching time intervals as shown in FIG. 11(*b*). Thus, the reaching time intervals Tp1 and Tp2 of the driving groups those are the first driving group and the second driving group are substantially equal to each other. In this case, the actual peak currents of the driving groups those are the first driving group and the second driving group are substantially equal to each other. As shown in FIG. 11(*b*), a timing that the sensed current of the second driving group reaches the target peak value Ip is shifted from a point A1 to a point A2. Thus, timings of the switchings from the high voltage V2 to the low voltage V1 in the driving groups those are the first driving group and the second driving group, that is, timings of switchings from the voltage-boosting driving of the fuel injector 30 to the valve-opening maintenance driving of the fuel injector 30, can be matched with each other. When the partially lifting injection is executed, the needle lifting quantities of the cylinders at the partially lifting state can be matched with each other.

Figure 12:
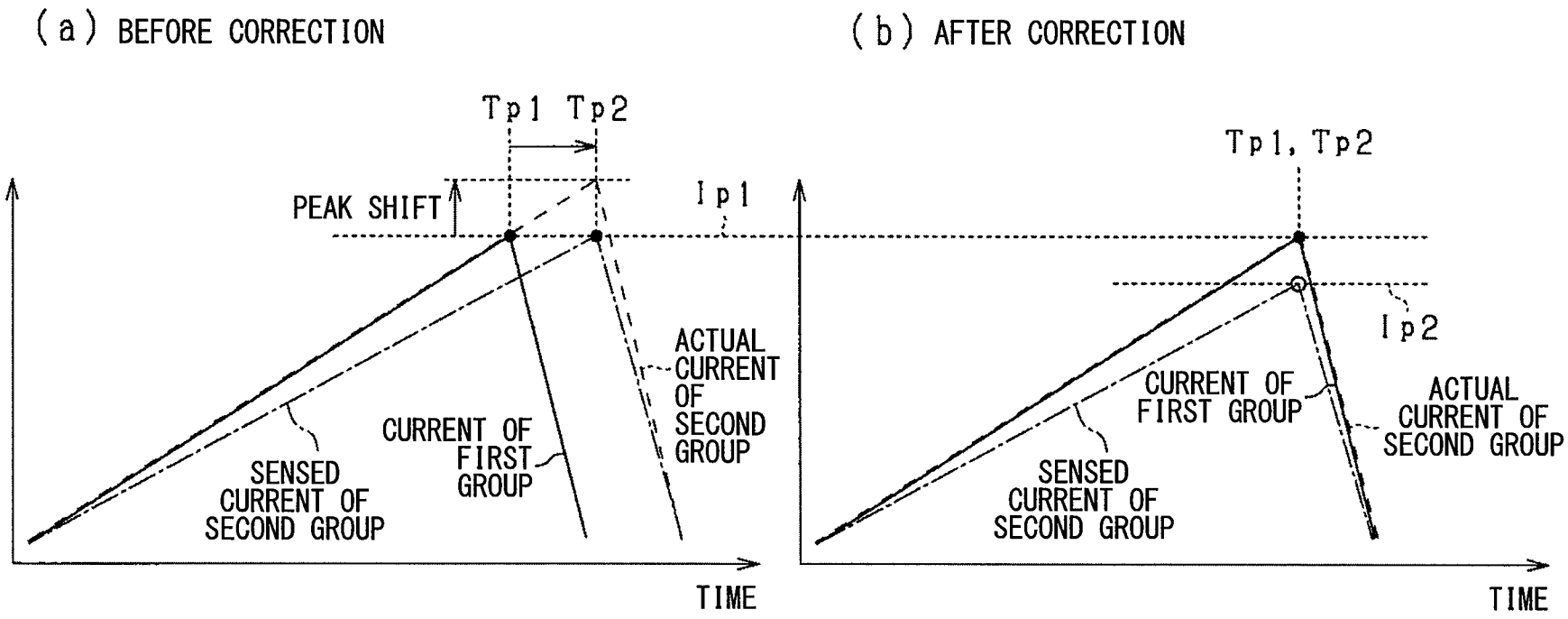
FIGS. 12*a* and 12*b* are time charts showing the peak current correction.

FIG. 12 is, similar to FIG. 11, a supplement diagram showing the correction of the target peak value Ip. FIG. 12 is different from FIG. 11 that, when the driving current is detected to be less than the actual current in the current detection circuit 44 of the second driving group, the target peak value Ip1 of the first driving group is set at the reference, and the adjustment of the target peak value Ip2 of the second driving group is executed. In this case, the reaching time interval of a system that the change quantity of the sensed current per unit time is small (a system that the reaching time interval is large) is controlled to be fit to a system that the change quantity of the sensed current per unit time is large (a system that the reaching time interval is small). In addition, FIG. 12(*a*) shows the same situation as FIG. 6(*a*).

As shown in FIG. 12(*a*), the peak current reaching time interval Tp2 of the second driving group is greater than the peak current reaching time interval Tp1 of the first driving group. As shown in FIG. 12(*b*), according to the above correction operation, the target peak value Ip2 of the second driving group is corrected to decrease. Then, the reaching time intervals Tp1 and Tp2 of the driving groups those are the first driving group and the second driving group are substantially equal to each other, and the actual peak currents of the driving groups those are the first driving group and the second driving group are substantially equal to each other. As shown in FIG. 12(*b*), similar to the above description, the timings of the switchings from the high voltage V2 to the low voltage V1 in the driving groups those are the first driving group and the second driving group, that is, the timings of the switchings from the voltage-boosting driving of the fuel injector 30 to the valve-opening maintenance driving of the fuel injector 30, can be matched with each other.

According to the present embodiment as the above description, following effects are obtained.

In a fuel injection system that divides plural fuel injectors 30 into plural driving groups (plural driving systems) and includes the current detection circuit 44 provided to each of the driving groups, the peak current reaching time intervals Tp are measured based on the sensed current of each of the current detection circuits 44, and the current correction of one of the driving groups is executed based on the difference between the reaching time intervals Tp of the current detection circuits 44. In this case, when injection instructions of the fuel injectors 30 are identical in a case where the characteristic variation occurs at one of the current detection circuits 44, the peak current reaching time intervals Tp differ from each other in the driving groups including the first driving group and the second driving group. However, the driving states of the fuel injectors 30 can be controlled to approach each other by executing the current correction based on the difference between the reaching time intervals Tp. As a result, an optimization of the driving of the fuel injectors 30 can be improved, and the fuel injection quantities can be properly controlled.

The correction of the target current is executed to uniform the peak current reaching time intervals Tp1 and Tp2 of the driving groups including the first driving group and the second driving group. In this case, since the reaching time intervals Tp1 and Tp2 of the driving groups including the first driving group and the second driving group are uniformed, the driving profiles of the fuel injectors 30 can be matched with each other. Thus, the variations of the fuel injection quantities of the fuel injectors 30 can be suppressed.

When it is determined that the sensed current has reached the target current value in a case where the characteristic variation occurs at one of the current detection circuit 44, it is assumed that the actual driving current differs from the target current value. Since the target current value in at least one of the driving groups including the first driving group and the second driving group is corrected, the target current value of each of the driving groups including the first driving group and the second driving group is determined, and a comparison between the target current value and the sensed current is executed. In this case, the timings that the actual driving currents reach the target current values in the driving groups including the first driving group and the second driving group can be matched with each other, and the variations of the fuel injection quantities are suppressed.

Specifically, when it is determined that the sensed current has reached the target peak value Ip in a case where the characteristic variation occurs at one of the current detection circuits 44, it is assumed that the actual peak current differs from the target peak value Ip. Since the target peak value Ip in at least one of the driving groups including the first driving group and the second driving group is corrected, the target peak value Ip of each of the driving groups including the first driving group and the second driving group is determined, and a comparison between the target peak value Ip and the sensed current is executed. In this case, the timings that the actual driving currents reach the target peak values Ip in the driving groups including the first driving group and the second driving group can be matched with each other, and the variations of the fuel injection quantities are suppressed. When the target peak value Ip is set in each of the driving groups including the first driving group and the second driving group, the valve-opening responsivities of the fuel injectors 30 can be matched with each other and then the variations of the fuel injection quantities can be suppressed.

Since the correction of the target holding value Ih is executed in addition of the correction of the target peak value Ip, the valve-opening responsivities of the fuel injectors 30 and valve-body lifting quantities of the fuel injectors 30 can be matched with each other and the variations of the fuel injection quantities can be suppressed.

When the characteristic variation occurs at one of the current detection circuits 44, a variation occurs at one of the voltage-boosting driving time interval in the fuel injector 30 and the valve-opening maintenance time interval in the fuel injector 30 between the driving groups with an increasing-decreasing tendency the same as that of the characteristic variation. When the target peak value Ip1 or Ip2 of the driving groups including the first driving group and the second driving group is corrected, the target holding value Ih of the corresponding driving group where the correction of the target peak value is executed is corrected. Thus, the correction of the target peak value can be properly corrected, and the driving states of the fuel injectors 30 can be properly matched with each other.

When a difference occurs between the reaching time intervals Tp1 and Tp2 of the driving groups including the first driving group and the second driving group, the current control for the smaller one of the reaching time intervals Tp1 and Tp2 (the larger one of the change quantities of the sensed currents per unit time) is executed to match the smaller one with the larger one of the reaching time intervals Tp1 and Tp2 (the smaller one of the change quantities of the sensed currents per unit time) (refer to FIGS. 9 and 11). Thus, the fuel injectors 30 can be driven while an excessive reduction of the energization current is suppressed. In other words, since the smaller one of the reaching time intervals Tp1 and Tp2 (the larger one of the change quantities of the sensed currents per unit time) is set as the correction subject, it can be suppressed that the energization currents of the fuel injectors 30 become excessively small in a case where the detection error occurs at one of the driving groups (driving systems). Thus, a stabilization of a system can be obtained and a stable operation of the fuel injector 30 can be ensured.

When the current control for the larger one of the reaching time intervals Tp1 and Tp2 (the smaller one of the change quantities of the sensed currents per unit time) is executed to match the larger one with the smaller one of the reaching time intervals Tp1 and Tp2 (the larger one of the change quantities of the sensed currents per unit time) (refer to FIGS. 10 and 12), an energy necessary to drive the fuel injector 30 can be reduced. In this case, when a normal driving of the fuel injector 30 is confirmed, an energy saving can be achieved while an operation maintenance is executed.

When the characteristic variation occurs at one of the current detection circuits 44, a difference of the characteristic variation increases accordance with an increase in time length of the energization state. Since a time interval from a reference timing to a timing that the sensed current reaches the target peak value Ip is measured as the reaching time interval, the difference of the characteristic variation of the current detection circuit 44 can be more accurately obtained than a case where a threshold current is established to be lower than the target peak value Ip.

When the characteristic variation occurs at one of the current detection circuits 44, the driving currents of the driving groups including the first driving group and the second driving group at a timing that the pre-charge is completed differ from each other. It is assumed that pre-charge complete timings of the driving groups including the first driving group and the second driving group differ from each other. Since a timing (more widely, a timing in a time interval where the application of the high voltage V2 is executed) that the application of the high voltage V2 starts after the pre-charge is completed is set as the reference timing to measure the peak current reaching time intervals Tp1 and Tp2, the correction of the target current can be properly executed without being affected by variations of the pre-charge complete timings in driving groups including the first driving group and the second driving group.

When the temperature difference occurs at the current detection circuits 44, it is possible that an accuracy of a measurement of each of the peak current reaching time intervals Tp1 and Tp2 is reduced due to an affection of the temperature difference. Since the temperature difference of the current detection circuits 44 in the driving groups including the first driving group and the second driving group is acquired and the peak current reaching time intervals Tp1 and Tp2 are corrected based on the temperature difference, a negative influence due to the temperature difference of the current detection circuits 44 can be suppressed.

When a condition that the fuel injection quantity of one driving of the fuel injector 30 is greater than or equal to a predetermined quantity and is not in a slight injection state, the peak current reaching time intervals Tp1 and Tp2 of the driving groups including the first driving group and the second driving group. When the peak current reaching time intervals Tp1 and Tp2 of the driving groups including the first driving group and the second driving group are measured, the driving current of each of the fuel injectors 30 certainly reaches the target peak value Ip. Thus, the peak current reaching time intervals Tp1 and Tp2 can be accurately obtained and an accuracy of the current correction can be improved.

Second Embodiment

Hereafter, a second embodiment of the present disclosure will be described mainly about different points from the first embodiment. According to the present embodiment, as the current change parameter, a reaching current that is the sensed current when a predetermined time interval has elapsed from a reference timing that is predetermined in each of the fuel injections of the fuel injectors 30 in the driving groups including the first driving group and the second driving group is obtained. A current correction is executed based on a difference between the reaching currents in the driving groups including the first driving group and the second driving group.

Figure 13:
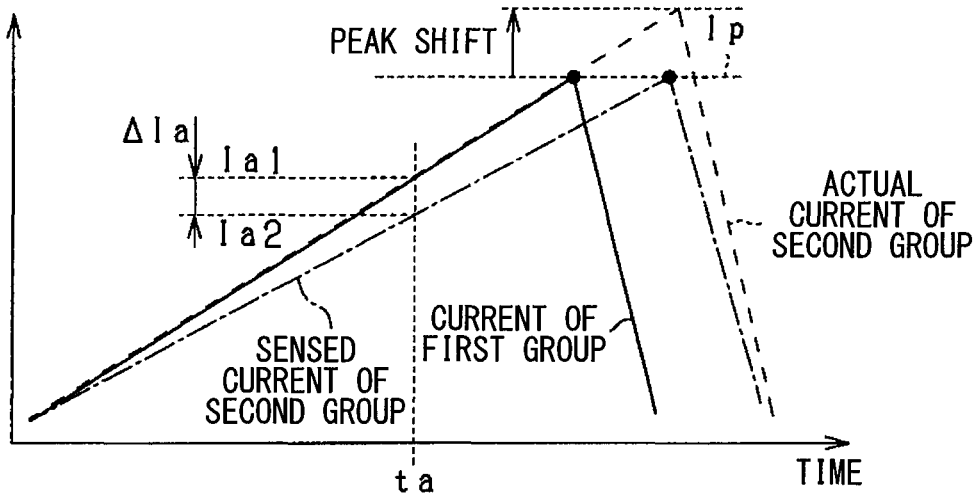
FIG. 13 is a time chart showing the detection shift of the current detection circuit.

FIG. 13 is a diagram showing the characteristic variation of each of the current detection circuits 44. In this case, FIG. 13 indicates a circumstance that the detection shift that is shifted toward a low current occurs only at the current detection circuit 44 of the second driving group. As shown in FIG. 13, a solid line indicates the sensed current of the current detection circuit 44 of the first driving group and matches the driving current (actual current) that actually flows through the fuel injector 30. A dotted-dashed line indicates the sensed current of the current detection circuit 44 of the second driving group, and a dashed line indicates the actual current that flows through the fuel injector 30 of the second driving group.

Figure 14:
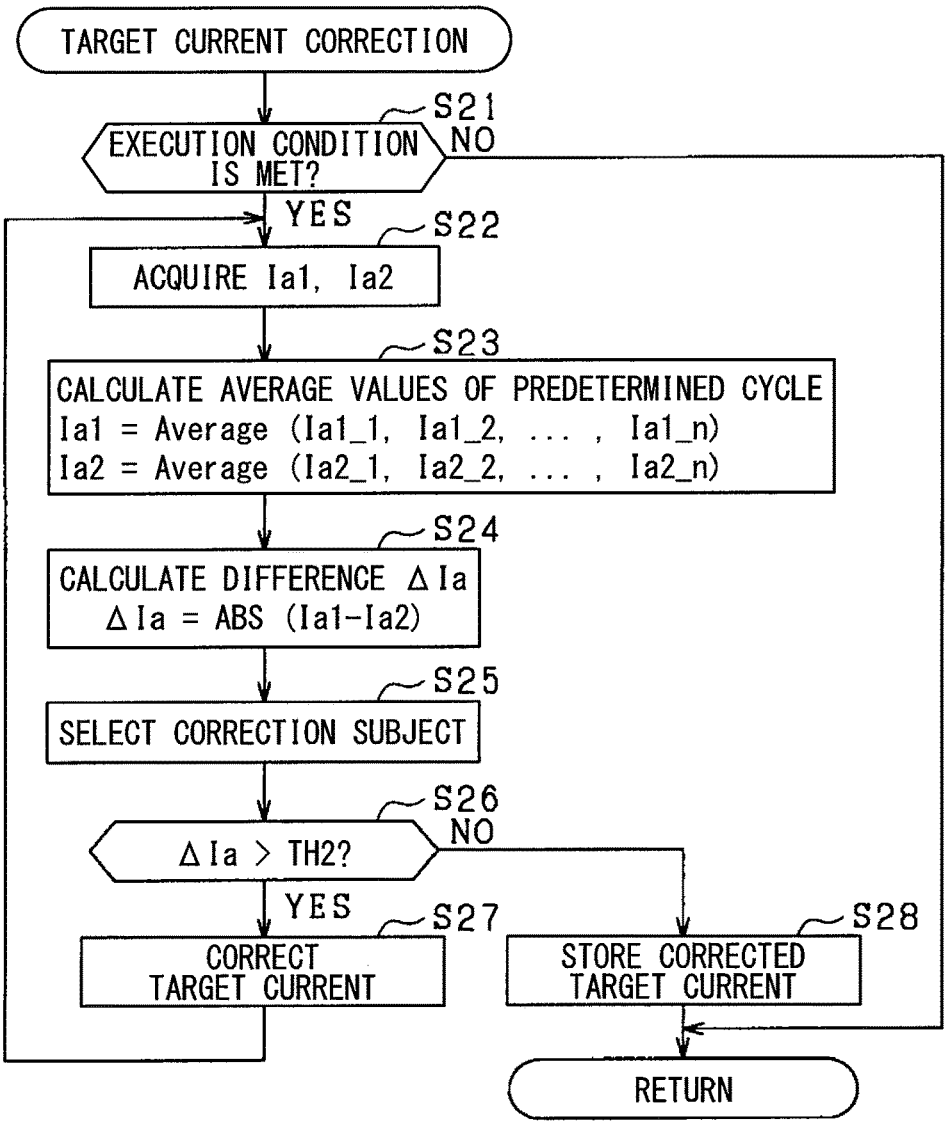
FIG. 14 is a flowchart showing a procedure of the target current correction operation, according to a second embodiment of the present disclosure.

As shown in FIG. 13, the change quantities of the sensed currents of the driving groups including the first driving group and the second driving group per unit time differ from each other. For example, the reaching currents Ia1 and Ia2 differ from each other (Ia1>Ia2), at a timing to that a predetermined time interval has elapsed from an energization start. The predetermined time interval is set to a time interval before the reaching currents Ia1 and Ia2 reach the peak current. In this case, the current correction is executed based on a difference of the reaching currents Ia1 and Ia2 of the driving groups FIG. 14 is a flowchart showing a procedure of the target current correction operation executed by the microcomputer 41. The present operation is executed by replacing that shown in FIG. 7. In FIG. 14, descriptions of steps the same as those shown in FIG. 7 will be omitted.

As shown in FIG. 14, at step S21, the microcomputer 41 determines whether the execution condition of the correction logic is met (the same as step S11 shown in FIG. 7). When the microcomputer 41 determines that step S21 is YES, the microcomputer 41 acquires the reaching currents Ia1 and Ia2 of the driving groups including the first driving group and the second driving group when the predetermined time interval has elapsed since the energization start at step S22. The microcomputer 41 acquires the reaching currents Ia1 and Ia2 in the driving of the fuel injectors 30 of the driving groups including the first driving group and the second driving group. At step S22, the microcomputer 41 may execute the temperature correction based on the temperature of each of the current detection circuits 44 for the reaching currents Ia1 and Ia2 those are acquired (the same as step S12 shown in FIG. 7).

Then, at step S23, the microcomputer 41 calculates the reaching currents Ia1 and Ia2 of the driving groups including the first driving group and the second driving group, by using average values of the reaching currents in a predetermined sampling number n. For example, n is equal to 20. Then, at step S24, the microcomputer 41 calculates an absolute value ΔIa of a difference between the reaching currents Ia1 and Ia2 of the driving groups including the first driving group and the second driving group.

Then, at step S25, the microcomputer 41 selects the driving group that is the correction subject based on magnitudes of the reaching currents Ia1 and Ia2. In this case, the microcomputer 41 selects the larger one of the reaching currents Ia1 and Ia2 of the driving groups including the first driving group and the second driving group, as the correction subject. Alternatively, the microcomputer 41 may select the smaller one of the reaching currents Ia1 and Ia2 of the driving groups including the first driving group and the second driving group, as the correction subject.

Figure 15:
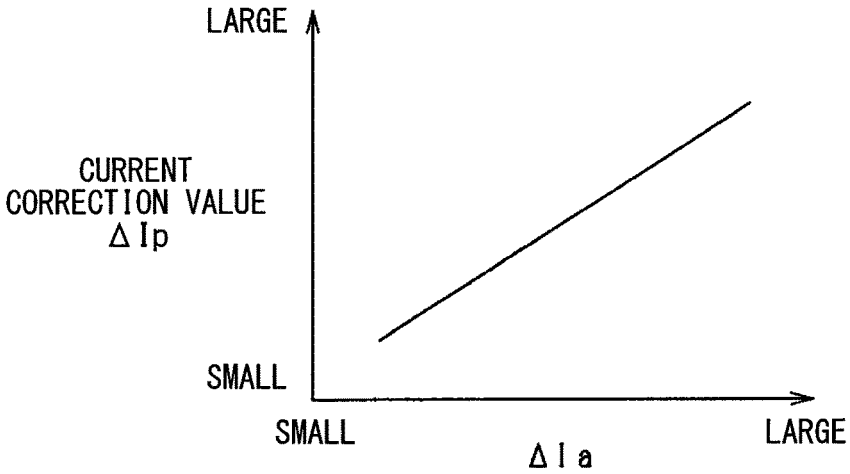
FIG. 15 is a graph showing a relationship between a difference ΔIa of reaching currents and the current correction value ΔIp.

Then, at step S26, the microcomputer 41 determines whether ΔIa is greater than a threshold TH2 that is predetermined. When the microcomputer 41 determines that ΔIa is greater than TH2, the microcomputer 41 proceeds to step S27. At step S27, the microcomputer 41 executes the correction of the target current. In this case, the microcomputer 41 executes the correction of the target peak value Ip in the voltage-boosting driving time interval for the driving group of the driving groups including the first driving group and the second driving group that is the correction subject. Specifically, the microcomputer 41 calculates the current correction value ΔIp based on ΔIa by using a relationship shown in FIG. 15. According to the relationship shown in FIG. 15, the microcomputer 41 calculates the current correction value ΔIp to increase in accordance with an increase in ΔIa. The microcomputer 41 corrects one of the target peak values Ip1 and Ip2 of the driving groups including the first driving group and the second driving group which is necessary to be corrected, by the current correction value ΔIp (Ipx=Ipx+ΔIp). Thus, the target peak value Ip is corrected to uniform the peak current reaching time intervals Tp of the driving groups those are the first driving group and the second driving group.

At step S27, the microcomputer 41 executes the correction of the target holding value Ih in the valve-opening maintenance time interval in addition of the correction of the target peak value Ip in the voltage-boosting driving time interval. However, specifications of step S27 are equivalent to those of step S17 shown in FIG. 7. The microcomputer 41 returns to step S22 after executing the correction of the target current. The microcomputer 41 repeatedly executes steps S22 to S27 until the microcomputer 41 determines that step S26 is NO.

When the microcomputer 41 determines that ΔIa is less than or equal to TH2 at step S26, the microcomputer 41 proceeds to step S28. At step S28, when the microcomputer 41 has executed the current correction in the present correction operation, the microcomputer 41 stores the correction result of the current correction (the same as step S18 shown in FIG. 7).

According to the present embodiment, the same as the first embodiment, the optimization of the driving of the fuel injectors 30 can be improved, and the fuel injection quantities can be properly controlled.

Third Embodiment

Hereafter, a third embodiment of the present disclosure will be described mainly about different points from the first embodiment. According to the present embodiment, as the current change parameter, a current integration value that is obtained by integrating the sensed current from the reference timing that is predetermined in each of the fuel injections of the fuel injectors 30 in the driving groups including the first driving group and the second driving group to a timing that a predetermined time interval has elapsed from the reference timing is obtained. A current correction is executed based on a difference between the current integration values of the driving groups including the first driving group and the second driving group.

Figure 16:
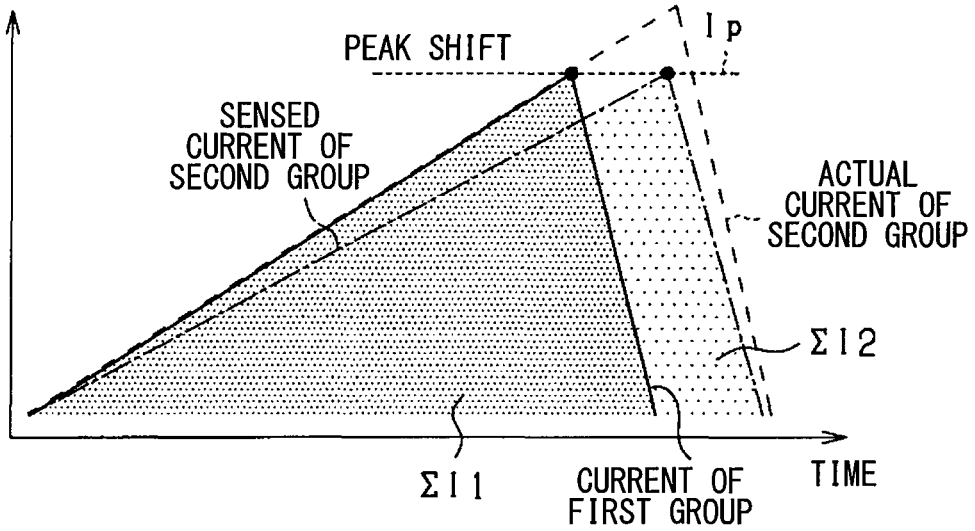
FIG. 16 is a time chart showing the detection shift of the current detection circuit.

FIG. 16 is a diagram showing the characteristic variation of each of the current detection circuits 44. In this case, FIG. 16 indicates a circumstance that the detection shift that is shifted toward a low current occurs only at the current detection circuit 44 of the second driving group. As shown in FIG. 16, a solid line indicates the sensed current of the current detection circuit 44 of the first driving group and matches the driving current (actual current) that actually flows through the fuel injector 30. A dotted-dashed line indicates the sensed current of the current detection circuit 44 of the second driving group, and a dashed line indicates the actual current that flows through the fuel injector 30 in the second driving group.

As shown in FIG. 16, the change quantities of the sensed currents of the driving groups including the first driving group and the second driving group per unit time differ from each other. For example, the current integration values $\Sigma I1$ and $\Sigma I2$ obtained by integrating the sensed currents from the energization start to an energization stop differ from each other ($\Sigma I1<\Sigma I2$). However, other than the above time interval, an integration time interval (predetermined time interval) where the sensed current is integrated may be a time interval from the energization start to a time point that the sensed currents reach a peak value (predetermined current value). In this case, the current correction is executed based on the difference between the current integration values $\Sigma I1$ and $\Sigma I2$ of the driving groups.

Figure 17:
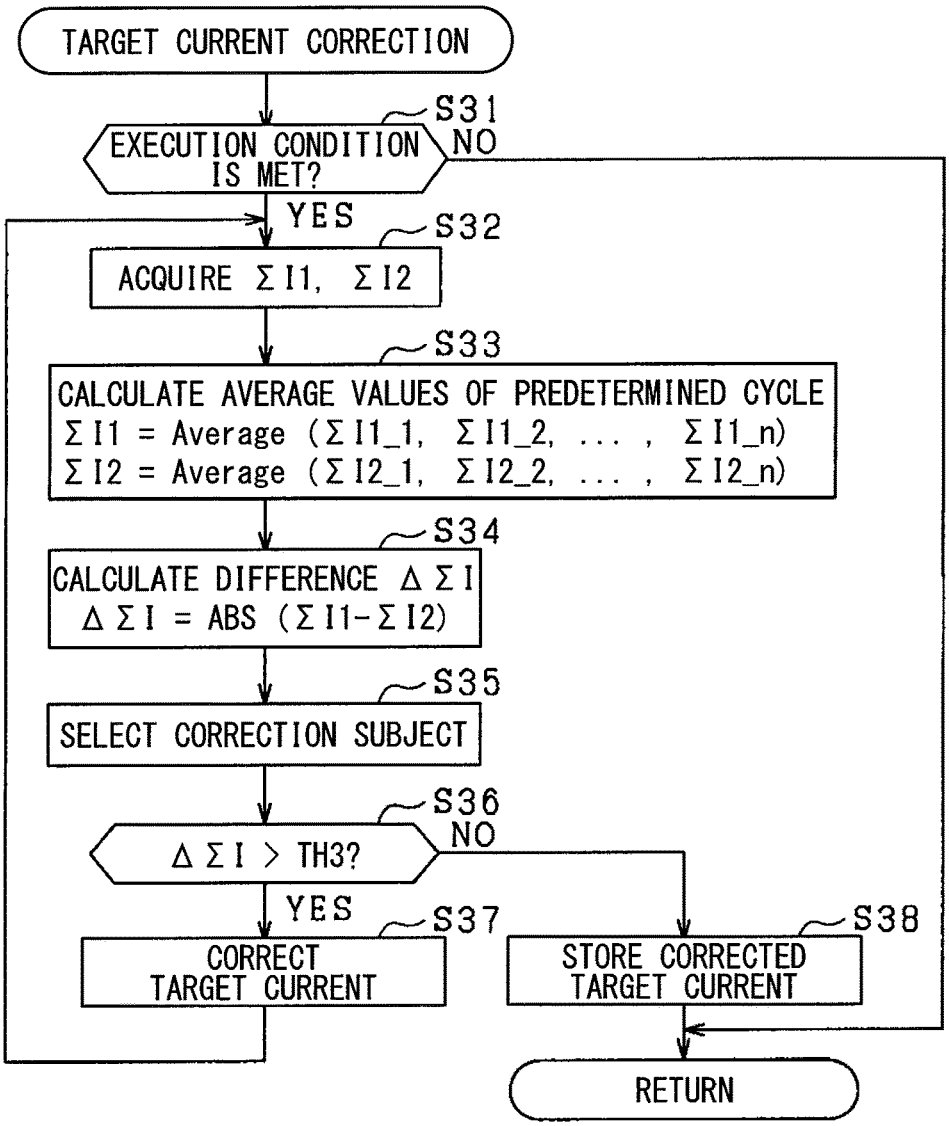
FIG. 17 is a flowchart showing a procedure of the target current correction operation, according to a third embodiment of the present disclosure.

FIG. 17 is a flowchart showing a procedure of the target current correction operation executed by the microcomputer 41. The present operation is executed by replacing that shown in FIG. 7. In FIG. 17, descriptions of steps the same as those shown in FIG. 7 will be omitted.

As shown in FIG. 17, at step S31, the microcomputer 41 determines whether the execution condition of the correction logic is met (the same as step S11 shown in FIG. 7). When the microcomputer 41 determines that step S31 is YES, the microcomputer 41 acquires the current integration values $\Sigma I1$ and $\Sigma I2$ of the driving groups including the first driving group and the second driving group at S32. The microcomputer 41 acquires $\Sigma I1$ and $\Sigma I2$ in the driving of the fuel injectors 30 in the driving groups including the first driving group and the second driving group. At step S32, the microcomputer 41 may execute the temperature correction based on the temperatures of the current detection circuits 44 for the current integration values $\Sigma I1$ and E2 those are acquired (the same as step S12 shown in FIG. 7).

The, at step S33, the microcomputer 41 calculates the current integration values $\Sigma I1$ and $\Sigma I2$ of the driving groups including the first driving group and the second driving group, by using average values of the current integration values in a predetermined sampling number n. For example, n is equal to 20. Then, at step S34, the microcomputer 41 calculates an absolute value $\Delta\Sigma I$ of the difference between the current integration values $\Sigma I1$ and $\Sigma I2$ of the driving groups including the first driving group and the second driving group.

Then, at step S35, the microcomputer 41 selects the driving group that is the correction subject based on magnitudes of the current integration values $\Sigma I1$ and $\Sigma I2$. In this case, the microcomputer 41 selects the larger one of the current integration values $\Sigma I1$ and $\Sigma I2$ of the driving groups including the first driving group and the second driving group, as the correction subject. Alternatively, the microcomputer 41 may select the smaller one of the current integration values $\Sigma I1$ and $\Sigma I2$ of the driving groups including the first driving group and the second driving group, as the correction subject.

Figure 18:
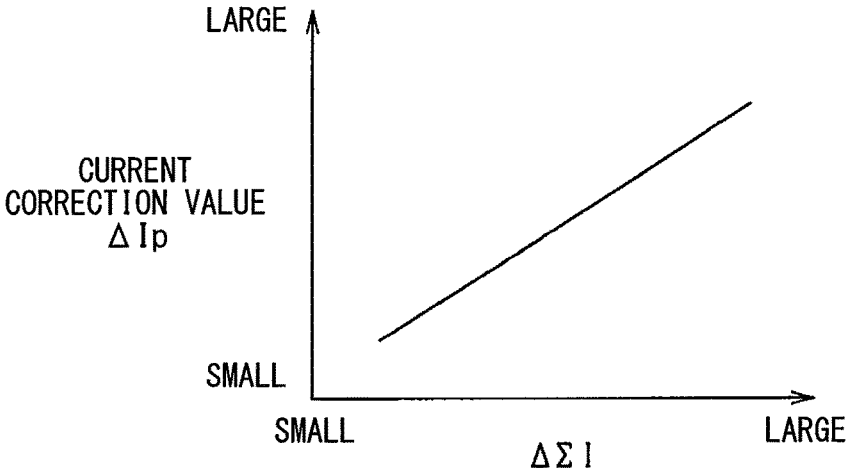
FIG. 18 is a graph showing a relationship between a difference ΔΣI of current integrated values and the current correction value ΔIp.

Then, at step S36, the microcomputer 41 determines whether $\Delta\Sigma I$ is greater than a threshold TH3 that is predetermined. When the microcomputer 41 determines that $\Sigma\Sigma I$ is greater than TH3, the microcomputer 41 proceeds to step S37. At step S37, the microcomputer 41 executes the correction of the target current. In this case, the microcomputer 41 executes the correction of the target peak value Ip in the voltage-boosting driving time interval for the driving group of the driving groups including the first driving group and the second driving group that is the correction subject. Specifically, the microcomputer 41 calculates the current correction value $\Delta Ip$ based on $\Delta\Sigma I$ by using a relationship shown in FIG. 18. According to the relationship shown in FIG. 18, the microcomputer 41 calculates a value that increases in accordance with an increase in $\Delta\Sigma I$, as the current correction value $\Delta Ip$. The microcomputer 41 corrects one of the target peak values Ip1 and Ip2 of the driving groups including the first driving group and the second driving group which is necessary to be corrected, by the current correction value $\Delta Ip$ ($Ipx=Ipx+\Delta Ip$). Thus, the target peak value Ip is corrected to uniform the peak current reaching time intervals Tp of the driving groups including the first driving group and the second driving group.

At step S37, the microcomputer 41 executes the correction of the target holding value Ih in the valve-opening maintenance time interval in addition of the correction of the target peak value Ip in the voltage-boosting driving time interval. However, specifications of step S37 are equivalent to those of step S17 shown in FIG. 7. The microcomputer 41 returns to step S32 after executing the correction of the target current. The microcomputer 41 repeatedly executes steps S32 to S37 until the microcomputer 41 determines that step S36 is NO.

When the microcomputer 41 determines that $\Delta\Sigma I$ is less than or equal to TH3 at step S36, the microcomputer 41 proceeds to step S38. At step S38, when the microcomputer 41 has executed the current correction in the present correction operation, the microcomputer 41 stores the correction result of the current correction (the same as step S18 shown in FIG. 7).

According to the present embodiment, the same as the first embodiment, the optimization of the driving of the fuel injectors 30 can be improved, and the fuel injection quantities can be properly controlled.

Other Embodiment

The above-mentioned embodiment may be modified as follows.

According to the first embodiment, the peak current reaching time interval Tp is measured when a timing that the application of the high voltage V2 starts after the pre-charge is completed as the reference timing. However, the reference timing may be changed. Specifically, the peak current reaching time interval Tp may be measured when a timing that the injection pulse is turned on is set as the reference timing. In this case, the timing that the injection pulse is turned on is a timing that an energization of the fuel injector 30 starts.

Further, the microcomputer 41 may measure a reaching time interval from the reference timing to a timing that the sensed current reaches a predetermined current value lower than the target peak value Ip instead of measuring the peak current reaching time interval Tp from the reference timing to a timing that the sensed current reaches the target peak value Ip.

According to the first embodiment, the longer one (or the shorter one) of the peak current reaching time intervals Tp1 and Tp2 of the driving groups including the first driving group and the second driving group is set as the target reaching time interval, and the correction of the target peak value Ip is executed based on the difference ΔTp between the reaching time intervals. However, the target reaching time interval may be changed. Specifically, an average of the peak current reaching time intervals Tp1 and Tp2 of the driving groups including the first driving group and the second driving group may be set as the target reaching time interval, and the correction of the target peak value Ip may be executed based on a difference ΔTp between the reaching time intervals. Alternatively, a target driving time interval that is the target reaching time interval may be a specified value that is previously set. In the above cases, the correction of the target peak value Ip is executed to uniform the reaching time intervals Tp1 and Tp2 of the driving groups including the first driving group and the second driving group.

When the correction of the target value Ip is executed based on the difference ΔTp of the reaching time intervals in a case where the average of the peak current reaching time intervals Tp1 and Tp2 of the driving groups including the first driving group and the second driving group is set as the target reaching time interval, both the target peak values Ip1 and Ip2 of the driving groups including the first driving group and the second driving group are corrected. In this case, the target peak value Ip of one of the driving groups is corrected to increase, and the target peak value Ip of the other one of the driving groups is corrected to decrease.

According to the above embodiments, the current correction is executed based on a difference of the current change parameters (reaching time intervals, reaching currents, current integration values) of the driving systems. However, the current correction may be changed. Specifically, the current correction may be executed based on a result of a comparison of the current change parameters (reaching time intervals, reaching currents, current integration values) of the driving systems. More specifically, the current correction may be executed based on a ratio of the current change parameters of the driving systems.

According to the above embodiments, when the target current value (e.g., target peak value) is updated, a limitation of the update may be set. Specifically, an upper limit value of the target current value is set. Alternatively, in a configuration where the target current value is increased or decreased according to the difference ΔTp of the reaching time intervals, a threshold that is used in a threshold determination of the difference ΔTp of the reaching time intervals may have a hysteresis. In this case, a first threshold and a second threshold are set (first threshold>second threshold). When the target current value is increased, the target current value is gradually increased until the difference ΔTp reaches the first threshold. When the target current value is decreased, the target current value is gradually decreased until the difference ΔTp reaches the second threshold.

Figure 19:
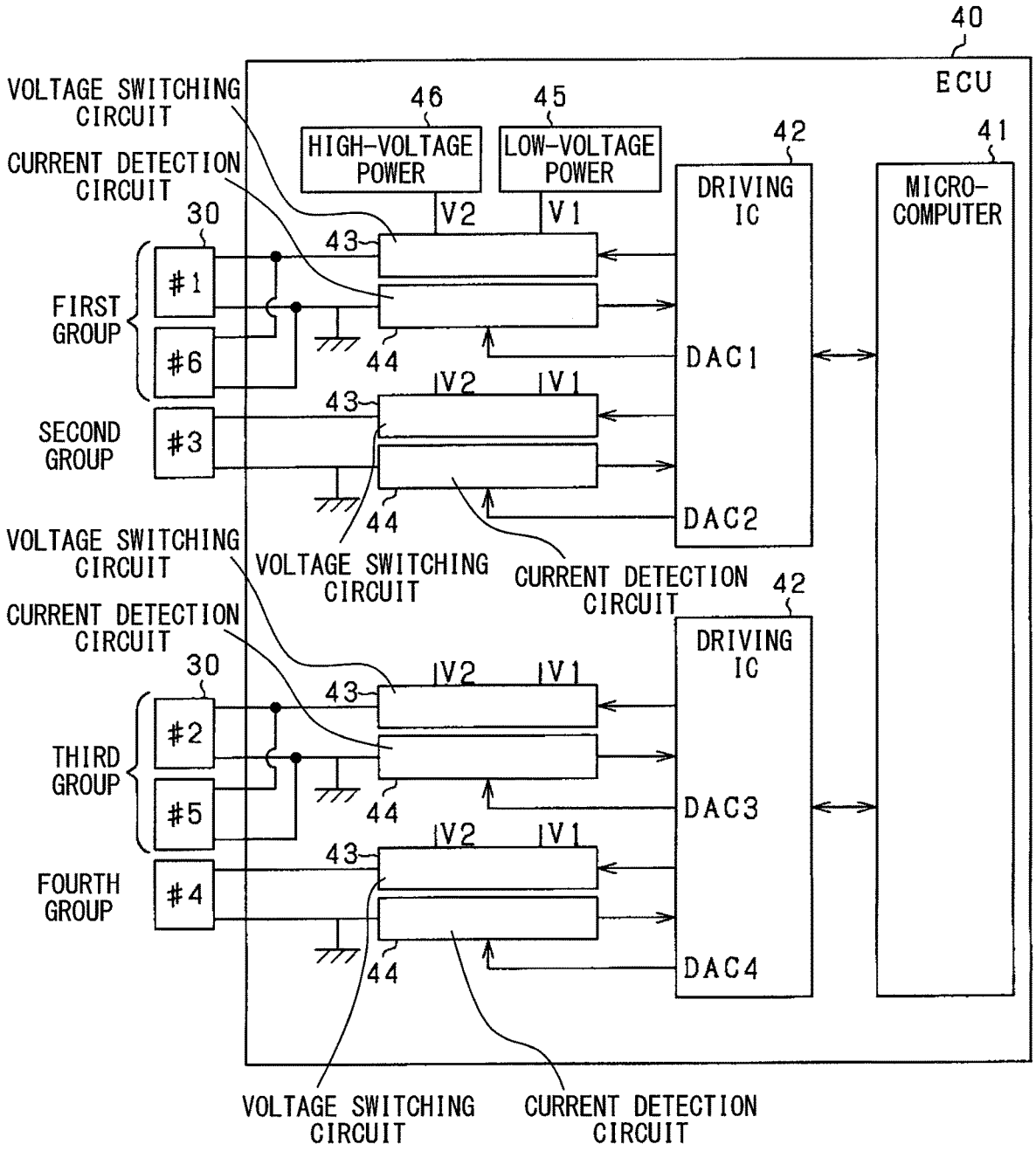
FIG. 19 is a block diagram showing a constitution of the ECU according to another example.

Another constitution of the ECU 40 will be described. FIG. 19 is a diagram showing a constitution used in a straight-line six-cylinder engine. In this case, a combustion order of cylinders of the straight-line six-cylinder engine is that #1, #5, #3, #6, #2 and #4. In this case, similar to the four-cylinder engine, a fuel injection is executed in an intake stroke and a compression stroke by the fuel injector 30 of each of cylinders.

In the constitution shown in FIG. 19, cylinders those do not have an overlapped time interval of the fuel injections are established as a driving group. A voltage switching circuit 43 and a current detection circuit 44 are provided to each of the driving groups. That is, cylinder #1 and cylinder #6 are established as a first driving group, cylinder #3 is established as a second driving group, cylinder #2 and cylinder #5 are established as a third driving group, and cylinder #4 is established as a fourth driving group, and then the voltage switching circuit 43 and the current detection circuit 44 are provided to each of the driving groups those are the first driving group, the second driving group, the third driving group and the fourth driving group. Alternatively, cylinder #3 and cylinder #4 may be established as the third driving group.

Alternatively, three cylinders may be established as a driving group when the cylinders do not have an overlapped time interval of the fuel injections.

When plural fuel injectors 30 are established as plural driving groups, a total number of cylinders and a total number of the fuel injectors 30 in each of the driving system are arbitrary. For example, in a two-cylinder engine, each of cylinders (each of fuel injectors) may be established as an individual driving group. It is also applied to an engine including three or more cylinders.

The high-voltage power unit 46 that outputs the high voltage V2 may be constituted by a high-voltage battery without including the voltage boosting circuit that boosts the battery voltage.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

The invention claimed is:

1. A fuel injection control device for an internal combustion engine which is applied to a fuel injection system of the internal combustion engine, the fuel injection system including fuel injectors, driving circuits that drive the fuel injectors in each of driving systems into which the fuel injectors are divided, and current detection circuits that are provided to the driving systems, respectively, and the current detection circuits that sense driving currents of corresponding fuel injectors, the fuel injection control device controlling a driving voltage applied to at least one fuel injector by at least one driving circuit, based on a condition that the sensed current obtained by the current detection circuit has reached a target peak value that is predetermined, wherein, the fuel injection control device comprising:

an acquisition unit to acquire a current change parameter that is a parameter correlative to a change quantity of the sensed current per unit time in each of the driving systems; and a current correction unit to:

calculate a correction value for a correction subject of the driving systems by using a predetermined relationship between a difference in the current change parameter and a correction value of the target peak value of each of the driving systems, based on a result of a comparison between the current change parameter of a first driving system and the current change parameter of a second driving system of the driving systems acquired by the acquisition unit, and correct the target peak value of the correction subject based on the correction value.

2. The fuel injection control device for the internal combustion engine according to claim 1, wherein the acquisition unit acquires a reaching time interval that is a time interval from a reference timing that is predetermined in each of fuel injections of the fuel injectors in the driving systems to a timing that the sensed current reaches a predetermined current value, as the current change parameter, and the current correction unit compares the reaching time intervals of the driving systems with each other and executes the current correction based on a result of a comparison of the reaching time intervals.

3. The fuel injection control device for the internal combustion engine according to claim 2, wherein the driving circuit executes a pre-charge by using an application of a low voltage that is predetermined based on the sensed current obtained by each of the current detection circuits, before an application of a predetermined voltage for a valve-opening operation in fuel injections of the fuel injectors, and the acquisition unit acquires the current change parameter by setting a timing in a time interval where the application of the predetermined voltage is executed after the pre-charge is completed as the reference timing.

4. The fuel injection control device for the internal combustion engine according to claim 3, wherein the acquisition unit acquires the current change parameter by setting a timing that the application of the predetermined voltage starts after the pre-charge is completed as the reference timing.

5. The fuel injection control device for the internal combustion engine according to claim 1, wherein the acquisition unit acquires a reaching current that is the sensed current when a predetermined time interval has elapsed from a reference timing that is predetermined in each of fuel injections of the fuel injectors in the driving systems, as the current change parameter, and the current correction unit compares the reaching currents of the driving systems with each other and executes the current correction based on a result of a comparison of the reaching currents.

6. The fuel injection control device for the internal combustion engine according to claim 1, wherein the acquisition unit acquires a current integration value that is obtained by integrating the sensed current from a reference timing that is predetermined in each of fuel injections of the fuel injectors in the driving systems to a timing that a predetermined time interval has elapsed from the reference timing, as the current change parameter, and the current correction unit compares the current integration values in the driving systems with each other and executes the current correction based on a result of a comparison of the current integration values.

7. The fuel injection control device for the internal combustion engine according to claim 1, wherein the current correction unit executes a correction of the driving current to control an actual value of the current change parameter of each of the driving systems to be in a predetermined range.

8. The fuel injection control device for the internal combustion engine according to claim 1, further comprising:

a control unit to control a driving voltage applied to the fuel injector by the driving circuit, based on a condition that the sensed current obtained by the current detection circuit has reached a target current value that is predetermined, wherein the current correction unit executes the current correction to correct the target current value in at least one of the driving systems.

9. The fuel injection control device for the internal combustion engine according to claim 8, wherein the current correction unit corrects the target current value by matching the target current value of a driving system in the driving systems where the change quantity of the sensed current per unit time is large with the target current value of a driving system in the driving systems where the change quantity is small.

10. The fuel injection control device for the internal combustion engine according to claim 8, wherein the current correction unit corrects the target current value by matching the target current value of a driving system in the driving systems where the change quantity of the sensed current per unit time is small with the target current value of a driving system in the driving systems where the change quantity is large.

11. The fuel injection control device for the internal combustion engine according to claim 8, wherein the driving circuit applies a high voltage that is predetermined and is used for the valve-opening operation in the fuel injection of each of the injectors, the driving circuit stops an application of the high voltage and applies a low voltage that is predetermined and is used for a valve-opening maintenance, based on a condition that the driving current of the fuel injector in a high-voltage applying state has reached the target peak value, and the current correction unit executes a correction of the target current value to correct the target peak value in the correction subject of the driving systems.

12. The fuel injection control device for the internal combustion engine according to claim 11, wherein the fuel injection control device controls the driving current of the fuel injector at a target holding value in a low-voltage applying time interval for the valve-opening maintenance, and the current correction unit executes the correction of the target current value to correct the target peak value and the target holding value in the correction subject of the driving systems.

13. The fuel injection control device for the internal combustion engine according to claim 12, wherein when the current correction unit corrects the target peak value in the correction subject of the driving systems, the current correction unit corrects the target holding value of a corresponding driving system where the correction of the target peak value is executed based on the target peak value of each of the driving systems.

14. The fuel injection control device for the internal combustion engine according to claim 11, further comprising:

a driving-current regulation unit to control the driving current of the fuel injector at a target holding value in a low-voltage applying time interval for the valve-opening maintenance, wherein the current correction unit executes the correction of the target current value to correct the target peak value and the target holding value in the correction subject of the driving systems.

15. The fuel injection control device for the internal combustion engine according to claim 1, further comprising:

a parameter correction unit to acquire a temperature difference of the current detection circuits in the driving systems, and the parameter correction unit to correct the current change parameter acquired by the acquisition unit, based on the temperature difference.

16. The fuel injection control device for the internal combustion engine according to claim 11, further comprising:

a driving-current regulation unit to control the driving current of the fuel injector at a target holding value in a low-voltage applying time interval for the valve-opening maintenance, wherein the current correction unit correct the target peak value and the target holding value in of the driving systems.

17. The fuel injection control device for the internal combustion engine according to claim 1, wherein the driving circuit applies a high voltage that is predetermined and is used for the valve-opening operation in the fuel injection of each of the injectors, the driving circuit stops an application of the high voltage and applies a low voltage that is predetermined and is used for a valve-opening maintenance, based on a condition that the driving current of the fuel injector in a high-voltage applying state has reached the target peak value, the fuel injection control device controls the driving current of the fuel injector at a target holding value in a low-voltage applying time interval for the valve-opening maintenance, and the current correction unit corrects the target hold value of the correction subject based on a ratio of the target peak values of the driving systems, such that the target hold values are at the same ratio in the driving systems, when correcting the target peak value of the correction subject.

18. The fuel injection control device for the internal combustion engine according to claim 1, wherein the current correction unit is configured to correct the target peak value of the correction subject based on the correction value to uniform the current change parameter of the first driving system and the current change parameter of the second driving system.

19. The fuel injection control device for the internal combustion engine according to claim 1, wherein the current detection circuits include a first current detection circuit, which belongs to the first driving system, and a second current detection circuit, which belongs to the second driving system, the fuel injectors include a first fuel injector, which belongs to the first driving system, and a second fuel injector, which belongs to the second driving system, the first current detection circuit is configured to sense a driving current of the first fuel injector, and the second current detection circuit is configured to sense a driving current of the second fuel injector.

20. The fuel injection control device for the internal combustion engine according to claim 1, wherein the acquisition unit is configured to acquire a reaching time interval that is a time interval from a reference timing that is predetermined in each of fuel injections of the fuel injectors in the driving systems to a timing at which the sensed current reaches the target peak value, as the current change parameter, and the current correction unit is configured to compare the reaching time intervals of the driving systems with each other and execute the current correction based on a result of a comparison of the reaching time intervals.

* * * * *